US007850267B2

(12) United States Patent
Usuda

(10) Patent No.: US 7,850,267 B2
(45) Date of Patent: Dec. 14, 2010

(54) METHOD OF CONTROLLING DRIVE OF FUNCTION LIQUID DROPLET EJECTION HEAD; FUNCTION LIQUID DROPLET EJECTION APPARATUS; ELECTRO-OPTIC DEVICE; METHOD OF MANUFACTURING LCD DEVICE, ORGANIC EL DEVICE, ELECTRON EMISSION DEVICE, PDP DEVICE, ELECTROPHORETIC DISPLAY DEVICE, COLOR FILTER, ORGANIC EL; METHOD OF FORMING SPACER, METALLIC WIRING, LENS, RESIST, AND LIGHT DIFFUSION BODY

(75) Inventor: Hidenori Usuda, Matsumoto (JP)

(73) Assignee: Seiko Epson Corporation (JP)

( * ) Notice: Subject to any disclaimer, the term of this patent is extended or adjusted under 35 U.S.C. 154(b) by 712 days.

(21) Appl. No.: 11/879,200

(22) Filed: Jul. 16, 2007

(65) Prior Publication Data

US 2007/0257949 A1 Nov. 8, 2007

Related U.S. Application Data

(62) Division of application No. 10/800,940, filed on Mar. 15, 2004, now Pat. No. 7,258,408.

(30) Foreign Application Priority Data

Mar. 18, 2003 (JP) ..... 2003-073689

(51) Int. Cl.
*B41J 29/38* (2006.01)
*B41J 2/205* (2006.01)

(52) U.S. Cl. ..... 347/11; 347/10; 347/15

(58) Field of Classification Search ..... 347/22–36, 347/12, 11, 10, 15, 40; 428/201
See application file for complete search history.

(56) References Cited

U.S. PATENT DOCUMENTS

| | | | |
|---|---|---|---|
| 4,746,935 | A | 5/1988 | Allen |
| 6,328,395 | B1 | 12/2001 | Kitahara et al. |
| 6,364,450 | B1 | 4/2002 | Yamaguchi et al. |
| 6,488,349 | B1 | 12/2002 | Matsuo et al. |
| 6,502,914 | B2 | 1/2003 | Hosono et al. |

(Continued)

FOREIGN PATENT DOCUMENTS

CN 1320081 A 10/2001

(Continued)

*Primary Examiner*—Stephen D Meier
*Assistant Examiner*—Rene Garcia, Jr.
(74) *Attorney, Agent, or Firm*—Harness, Dickey & Pierce, P.L.C.

(57) ABSTRACT

In a method of controlling drive of a function liquid droplet ejection head in which a plurality of nozzle arrays are arranged, the nozzle arrays have function liquid droplet ejection amounts which are different from each other per unit nozzle. The drive of the plurality of nozzle arrays is controlled by using a single drive signal having a plurality of ejection pulses corresponding to the plurality of nozzle arrays in one print cycle. Thus, even if a plurality of nozzle arrays having function liquid droplet ejection amounts which are different from each other per unit nozzle are disposed in one function liquid droplet ejection head, easy drive control is possible without lowering printing throughput.

19 Claims, 23 Drawing Sheets

U.S. PATENT DOCUMENTS

| | | | |
|---|---|---|---|
| 6,527,354 | B2 | 3/2003 | Takahashi |
| 6,783,210 | B2 | 8/2004 | Takahashi et al. |
| 6,789,877 | B2 | 9/2004 | Murakami et al. |
| 6,863,370 | B2 | 3/2005 | Ogawa et al. |
| 6,863,961 | B2 | 3/2005 | Miyashita et al. |
| 6,896,357 | B2 | 5/2005 | Murakami et al. |
| 6,905,190 | B1 | 6/2005 | Otsuka et al. |
| 6,933,958 | B2 | 8/2005 | Nakamura et al. |
| 6,966,621 | B2 | 11/2005 | Takahashi et al. |
| 6,969,155 | B2 | 11/2005 | Umezawa |
| 2001/0002134 | A1 | 5/2001 | Minowa et al. |
| 2003/0085962 | A1 | 5/2003 | Junhua |
| 2004/0218007 | A1 | 11/2004 | Tomizawa et al. |
| 2006/0050107 | A1 | 3/2006 | Yamanaka et al. |

FOREIGN PATENT DOCUMENTS

| | | |
|---|---|---|
| JP | 05-201003 | 8/1993 |
| JP | 10-081012 | 3/1998 |
| JP | 10-305575 | 11/1998 |
| JP | 2001-001549 | 1/2001 |
| JP | 2001-219558 | 8/2001 |
| JP | 2002-303715 | 10/2002 |
| JP | 2002-337333 | 11/2002 |

METHOD OF CONTROLLING DRIVE OF FUNCTION LIQUID DROPLET EJECTION HEAD; FUNCTION LIQUID DROPLET EJECTION APPARATUS; ELECTRO-OPTIC DEVICE; METHOD OF MANUFACTURING LCD DEVICE, ORGANIC EL DEVICE, ELECTRON EMISSION DEVICE, PDP DEVICE, ELECTROPHORETIC DISPLAY DEVICE, COLOR FILTER, ORGANIC EL; METHOD OF FORMING SPACER, METALLIC WIRING, LENS, RESIST, AND LIGHT DIFFUSION BODY

RELATED APPLICATION

This is a divisional application of U.S. Ser. No. 10/800,940 filed Mar. 15, 2004, which claims priority to Japanese Patent Application No. 2003-073689 filed Mar. 18, 2003, all of which are hereby expressly incorporated by reference herein in their entirety.

BACKGROUND OF THE INVENTION

1. Field of the Invention

This invention relates to: a method of controlling drive of a function liquid droplet ejection head having disposed therein a plurality of nozzle arrays with a different function liquid droplet ejection amount per unit nozzle; a function liquid droplet ejection apparatus; an electro-optic device; a method of manufacturing a liquid crystal display device; a method of manufacturing an organic electroluminescence (EL) device; a method of manufacturing an electron emission device; a method of manufacturing a plasma display panel (PDP) device; a method of manufacturing an electrophoretic display device; a method of manufacturing a color filter; a method of manufacturing an organic EL; a method of forming a spacer; a method of forming a metallic wiring; a method of forming a lens; a method of forming a resist; and a method of forming a light diffusion body (or member).

2. Description of the Related Art

Conventionally, there has been known an ink jet printer using an ink jet head in which two nozzle arrays are disposed, the nozzle arrays having different function liquid droplet ejection amounts (nozzle orifice or opening diameters) per unit nozzle. In this type of ink jet printer, since nozzle arrangement densities of the respective nozzle arrays are different, combination of these nozzle arrays makes it possible to realize printing in a plurality of resolutions.

In the case of driving the above-described ink jet head, the drive thereof is controlled by using different drive signals for the respective nozzle arrays. Therefore, for each of the nozzle arrays, there are prepared a plurality of (two, in the case of the above-described ink jet head): waveforms (ejection pulses) which are applied to eject ink; micro oscillation waveforms (micro oscillation pulses) which are applied as countermeasures against thickening; and damping waveforms (damping pulses) which are applied to weaken residual oscillation of pressure generating elements after ejection waveforms are applied. Consequently, the respective nozzle arrays are controlled separately. However, when the number of nozzle arrays increases, a drive signal generation part (drive waveform generation part) is required to prepare drive waveforms in accordance with the number of arrays and to apply the drive waveforms to the respective nozzle arrays. Thus, there is a problem in that control of drive of the ink jet head becomes complicated.

Moreover, an arrangement is conceivable in which a plurality of nozzle arrays are driven by switching drive signals applied to the respective nozzle arrays in the drive signal generation part. However, with this arrangement, there is assumed to be a problem in that time required for switching the drive signals lowers printing throughput.

SUMMARY OF THE INVENTION

In view of the above-described problems, it is an advantage of this invention to provide: a method of controlling drive of a function liquid droplet ejection head, which can easily control drive of the head without lowering printing throughput even if a plurality of nozzle arrays are arranged in one function liquid droplet ejection head, the nozzle arrays having different function liquid droplet ejection amounts per unit nozzle; a function liquid droplet ejection apparatus; an electro-optic device; a method of manufacturing a liquid crystal display device; a method of manufacturing an EL device; a method of manufacturing an electron emission device; a method of manufacturing a PDP device; a method of manufacturing an electrophoretic display device; a method of manufacturing a color filter; a method of manufacturing an organic EL; a method of forming a spacer; a method of forming a metallic wiring; a method of forming a lens; a method of forming a resist; and a method of forming a light diffusion body.

According to one aspect of this invention, there is provided a method of controlling drive of a function liquid droplet ejection head having disposed therein a plurality of nozzle arrays with a different function liquid droplet ejection amount per unit nozzle, wherein, in one print cycle, drive of the plurality of nozzle arrays is controlled by using a single drive signal having a plurality of ejection pulses corresponding to the plurality of nozzle arrays.

According to another aspect of this invention, there is provided a function liquid droplet ejection apparatus which selectively ejects function liquid droplets while performing a relative movement between a function liquid droplet ejection head into which a function liquid is introduced and a workpiece. The apparatus comprises: the function liquid droplet ejection head having disposed therein a plurality of nozzle arrays with a different function liquid droplet ejection amount per unit nozzle; and control means for controlling drive of the plurality of nozzle arrays by using a single drive signal, wherein the drive signal has a plurality of ejection pulses corresponding to the plurality of nozzle arrays in one print cycle.

According to the above-described arrangements, there is used the function liquid droplet ejection head in which the plurality of nozzle arrays have different function liquid droplet ejection amounts per unit nozzle. Thus, the function liquid droplets can be efficiently ejected within one pixel (i.e., the function liquid droplets can efficiently travel to respective pixels) and a uniform film thickness can thus be obtained. Moreover, drive of the plurality of nozzle arrays arranged in the function liquid droplet ejection head is controlled by using a single drive signal. Thus, there is no need of generating drive signals in accordance with the number of nozzle arrays. Consequently, processing of generating the drive signals can be easily performed. Furthermore, the drive signal has the plurality of ejection pulses corresponding to the plurality of nozzle arrays in one print cycle. Accordingly, there is no need of switching the drive signals applied to the respective nozzle arrays. Thus, high-frequency drive becomes possible; i.e., printing throughput can be improved.

Preferably, the plurality of ejection pulses have waveforms which are different from each other in accordance with specifications of corresponding nozzle arrays.

According to this arrangement, the respective nozzle arrays are driven by using the ejection pulses having waveforms which are different from each other, in accordance with the specifications of the corresponding nozzle arrays. Thus, nozzles having various specifications (a nozzle orifice diameter, a shape of a nozzle orifice and the like) can be used. In addition, function liquids with various weights or viscosities can be ejected.

Preferably, the drive of the plurality of nozzle arrays is controlled by using an identical ejection pulse in case of performing flushing which is function recovery processing by waste discharging of liquid droplets from all nozzles.

Preferably, the control means controls the plurality of nozzle arrays by using an identical ejection pulse in case of performing flushing which is function recovery processing by waste discharging of liquid droplets from all nozzles.

According to the above-described arrangements, the flushing that is the function recovery processing does not require fine adjustment of the amount of function liquid droplets to be ejected or high ejection accuracy. Thus, the drive of the plurality of nozzle arrays can be easily controlled by using the same ejection pulse. Moreover, since the print cycle is shortened accordingly, in the case of performing the flushing, high-frequency drive is possible.

Preferably, the drive signal has a micro oscillation pulse which subjects a function liquid to form a meniscus of each nozzle to micro oscillation, and only one waveform of the micro oscillation pulse is inputted in said one print cycle.

According to the above-described arrangement, since the function liquid which forms the meniscus is subjected to the micro oscillation by using the micro oscillation pulse, it is possible to prevent the thickening of the function liquid in the vicinity of a nozzle orifice part. Thus, it is possible to maintain a good ejection state of the function liquid. Moreover, since only one waveform of the micro oscillation pulse is inputted regardless of the number of ejection pulses to be inputted later, influences on the printing throughput can be reduced. In other words, for example, in the case of driving two nozzle arrays having different function liquid droplet ejection amounts per unit nozzle, the drive thereof is generally performed by using independent drive signals. In this case, the respective drive signals require micro oscillation pulses as countermeasures against the thickening of the function liquid. However, according to the above-described arrangement, the two nozzle arrays having different function liquid droplet ejection amounts per unit nozzle are driven by using a single drive signal. Thus, the drive signal can be used in common with each other and, therefore, the shortening of the print cycle (improvement in the printing throughput) can be achieved.

Preferably, the micro oscillation pulse is inputted before input of the plurality of ejection pulses in said one print cycle.

According to this arrangement, since the micro oscillation pulse is inputted before the ejection pulses in one print cycle, a normal function liquid which is not thickened can be ejected even when a first ejection pulse is inputted.

Preferably, the drive signal has a damping pulse for damping residual oscillation of a pressure generating element which generates pressure fluctuations in a cavity communicated with each nozzle, and, in said one print cycle, the damping pulse is inputted after input of the plurality of ejection pulses and has a waveform corresponding to a waveform of the last inputted ejection pulse.

According to this arrangement, the drive signal has the damping pulse for damping the residual oscillation of the pressure generating elements. Thus, stable ejection of the function liquid can be constantly performed without giving influences of the last inputted ejection pulse on the next drive pulse. Moreover, since the damping pulse has the waveform corresponding to the waveform of the last inputted ejection pulse, the residual oscillation can be damped more surely.

Preferably, the plurality of nozzle arrays include a first nozzle array which ejects a first function liquid droplet ejection amount and a second nozzle array which ejects a second function liquid droplet ejection amount which is smaller than the first function liquid droplet ejection amount, and a number of nozzles in the second nozzle array is two times the number of nozzles in the first nozzle array.

According to this arrangement, the function liquid droplet ejection head includes the two nozzle arrays having different function liquid droplet ejection amounts per unit nozzle. Thus, by using a drive signal having two ejection pulses, function liquid droplets can easily and efficiently travel to, or reach, respective pixels. Moreover, the number of nozzles in the second nozzle array which ejects a smaller function liquid droplet ejection amount than that of the first nozzle array is two times the number of nozzles in the first nozzle array. Thus, pixels can be filled without leaving any space therein. Consequently, a more uniform film thickness can be obtained.

According to another aspect of this invention, there is provided an electro-optic device manufactured by using the above-described function liquid droplet ejection apparatus.

According to this arrangement, by using the function liquid droplet ejection head in which a plurality of nozzle arrays having different function liquid droplet ejection amounts per unit nozzle are disposed, function liquid droplets can efficiently reach respective pixels. In addition, an even film thickness can be obtained. Thus, a good electro-optic device can be manufactured efficiently. The electro-optic device includes a liquid crystal display device, an organic electro-luminescence (EL) device, an electron emission device, a plasma display panel (PDP) device, an electrophoretic display device and the like. The electron emission device conceptually includes a so-called field emission display (FED) device. Furthermore, as the electro-optic device, there is conceived a device including the above-described preparation formation other than formation of a metallic wiring, formation of a lens, formation of a resist, formation of a light diffusion body and the like.

According to still another aspect of this invention, there is provided a method of manufacturing a liquid crystal display device, in which a multiplicity of filter elements are formed on a color filter substrate by using the above-described function liquid droplet ejection apparatus. The method comprises the steps of: introducing filter materials of respective colors into the function liquid droplet ejection head; and performing a relative scanning between the function liquid droplet ejection head and the substrate to selectively eject the filter materials, whereby the multiplicity of the filter elements are formed.

According to still another aspect of this invention, there is provided a method of manufacturing an organic EL device, in which an EL layer is formed in each of a multiplicity of picture element pixels on a substrate by using the above-described function liquid droplet ejection apparatus. The method comprises the steps of: introducing luminescent materials of respective colors into the function liquid droplet ejection head; and performing a relative scanning between the function liquid droplet ejection head and the substrate to selectively eject the luminescent materials, whereby the multiplicity of EL layers are formed.

According to yet another aspect of this invention, there is provided a method of manufacturing an electron emission device, in which a multiplicity of phosphors are formed on electrodes by using the above-described function liquid droplet ejection apparatus. The method comprises the steps of: introducing fluorescent materials of respective colors into the function liquid droplet ejection head; and performing a relative scanning between the function liquid droplet ejection head and the electrodes to selectively eject the fluorescent materials, whereby the multiplicity phosphors are formed.

According to still another aspect of this invention, there is provided a method of manufacturing a PDP device, in which phosphors are formed in each of a multiplicity of concave portions on a rear substrate by using the above-described function liquid droplet ejection apparatus. The method comprises the steps of: introducing fluorescent materials of respective colors into the function liquid droplet ejection head; and performing a relative scanning between the function liquid droplet ejection head and the rear substrate to selectively eject the fluorescent materials, whereby the multiplicity of the phosphors are formed.

According to still another aspect of this invention, there is provided method of manufacturing an electrophoretic display device, in which migrating bodies are formed in each of a multiplicity of concave portions on electrodes by using the above-described function liquid droplet ejection apparatus. The method comprises the steps of: introducing migrating body materials of respective colors into the function liquid droplet ejection head; and performing a relative scanning between the function liquid droplet ejection head and the electrodes to selectively eject the migrating body materials, whereby the multiplicity of the migrating bodies are formed.

As described above, by applying the above-described function liquid droplet ejection apparatus to the method of manufacturing a liquid crystal display device, the method of manufacturing an organic electro-luminescence (EL) device, the method of manufacturing an electron emission device, the method of manufacturing a plasma display panel (PDP) device and the method of manufacturing an electrophoretic display device, a good electro-optic device can be manufactured quickly and easily. The scanning of the function liquid droplet ejection head generally includes main scanning and sub-scanning. In case where a so-called one line is constituted by a single function liquid droplet ejection head, only the main scanning is performed. Moreover, the electro-optic device conceptually includes a so-called field emission display (FED) device.

According to yet another aspect of this invention, there is provided a method of manufacturing a color filter, in which a color filter having disposed therein a multiplicity of filter elements is manufactured by using the above-described function liquid droplet ejection apparatus. The method comprises the steps of: introducing filter materials of respective colors in the function liquid droplet ejection head; and performing a relative scanning between the function liquid droplet ejection head and the substrate to selectively eject the filter materials, whereby the multiplicity of the filter elements are formed.

In this method, preferably, an overcoat film which covers the multiplicity of filter elements is formed. The method further comprises the steps of: introducing, after the filter elements are formed, a translucent coating material into the function liquid droplet ejection head; and performing relative scanning between the function liquid droplet ejection head and the substrate to selectively eject the coating material, whereby the overcoat film is formed.

According to another aspect of this invention, there is provided a method of manufacturing an organic EL in which a multiplicity of picture element pixels inclusive of EL layers are arranged on a substrate, by using the above-described function liquid droplet ejection apparatus. The method comprises the steps of: introducing luminescent materials of respective colors into the function liquid droplet ejection head; and performing relative scanning between the function liquid droplet ejection head and the substrate to selectively eject the luminescent materials, whereby the multiplicity of EL layers are formed.

Preferably, a multiplicity of pixel electrodes corresponding to the EL layers are formed between the multiplicity of EL layers and the substrate. The method further comprises the steps of: introducing a liquid electrode material into the function liquid droplet ejection head; and performing relative scanning between the function liquid droplet ejection head and the substrate to selectively eject the liquid electrode material, whereby a multiplicity of the pixel electrodes are formed.

In this method, preferably, a counter electrode is formed so as to cover the multiplicity EL layers. The method further comprises the steps of: introducing, after the EL layers are formed, the liquid electrode material into the function liquid droplet ejection head; and performing a relative scanning between the function liquid droplet ejection head and the substrate to selectively eject the liquid electrode material, whereby the counter electrode is formed.

According to yet another aspect of this invention, there is provided a method of forming a spacer, in which a multiplicity of particulate spacers are formed to constitute a minute cell gap between two substrates, by using the above-described function liquid droplet ejection apparatus. The method comprises the steps of: introducing a particle material constituting the spacers into the function liquid droplet ejection head; and performing a relative scanning between the function liquid droplet ejection head and at least one of the substrates to selectively eject the particle material, whereby the spacers are formed on the substrate.

According to yet another aspect of this invention, there is provided a method of forming a metallic wiring on a substrate by using the above-described function liquid droplet ejection apparatus. The method comprises the steps of: introducing a liquid metal material into the function liquid droplet ejection head; and performing a relative scanning between the function liquid droplet ejection head and the substrate to selectively eject the liquid metal material, whereby the metallic wiring is formed.

According to still further aspect of this invention, there is provided a method of forming a lens, in which a multiplicity of microlenses are formed on a substrate, by using the above-described function liquid droplet ejection apparatus. The method comprises the steps of: introducing a lens material into the function liquid droplet ejection head; and performing a relative scanning between the function liquid droplet ejection head and the substrate to selectively eject the lens material, whereby the multiplicity of microlenses are formed.

According to yet another aspect of this invention, there is provided a method of manufacturing a resist of an arbitrary shape on a substrate by using the above-described function liquid droplet ejection apparatus. The method comprises the steps of: introducing a resist material into the function liquid droplet ejection head; and performing a relative scanning between the function liquid droplet ejection head and the substrate to selectively eject the resist material, whereby the resist is formed.

According to still another aspect of this invention, there is provided a method of forming a light diffusion body, in which a multiplicity of light diffusion bodies are formed on a substrate, by using the above-described function liquid droplet ejection apparatus. The method comprises the steps of: introducing a light diffusion material into the function liquid droplet ejection head; and performing a relative scanning between the function liquid droplet ejection head and the substrate to selectively eject the light diffusion material, whereby the multiplicity of light diffusion bodies are formed.

As described above, by applying the above-described function liquid droplet ejection apparatus to the method of manufacturing a color filter, the method of manufacturing an organic EL, the method of forming a spacer, the method of forming a metallic wiring, the method of forming a lens, the method of forming a resist and the method of forming a light diffusion body, a good electro-optic device can be manufactured quickly and easily.

BRIEF DESCRIPTION OF THE DRAWINGS

The above and other objects and the attendant features of this invention will become readily apparent by reference to the following detailed description when considered in conjunction with the accompanying drawings wherein.

DETAILED DESCRIPTION OF THE PREFERRED EMBODIMENTS

Hereinafter, with reference to the accompanying drawings, descriptions will be made of a method of controlling drive of a function liquid droplet ejection head, a function liquid droplet ejection apparatus, an electro-optic device, a method of manufacturing a liquid crystal display device, a method of manufacturing an organic EL device, a method of manufacturing an electron emission device, a method of manufacturing a PDP device, a method of manufacturing an electrophoretic display device, a method of manufacturing a color filter, a method of manufacturing an organic EL, a method of forming a spacer, a method of forming a metallic wiring, a method of forming a lens, a method of forming a resist, and a method of forming a light diffusion body, according to this invention.

An ink jet head (function liquid droplet ejection head) of an ink jet printer can accurately eject dot-shaped minute ink droplets (function liquid droplets). Thus, the ink jet head is expected to be applied to manufacturing fields of various components, for example, by using a particular ink, a luminous or photosensitive resin and the like as a function liquid (a liquid to be ejected). Moreover, the function liquid droplet ejection apparatus of this embodiment is applied, for example, to an apparatus for manufacturing a so-called flat display such as a liquid crystal display device or an organic EL device. In the function liquid droplet ejection apparatus, a function liquid of a filter material, a luminescent material or the like is ejected from the function liquid droplet ejection head (an ink jet method). Accordingly, R, G and B filter elements in the liquid crystal display device or EL luminescent layers and hole injection layers of respective pixels in the organic EL device are formed.

Figure 1:
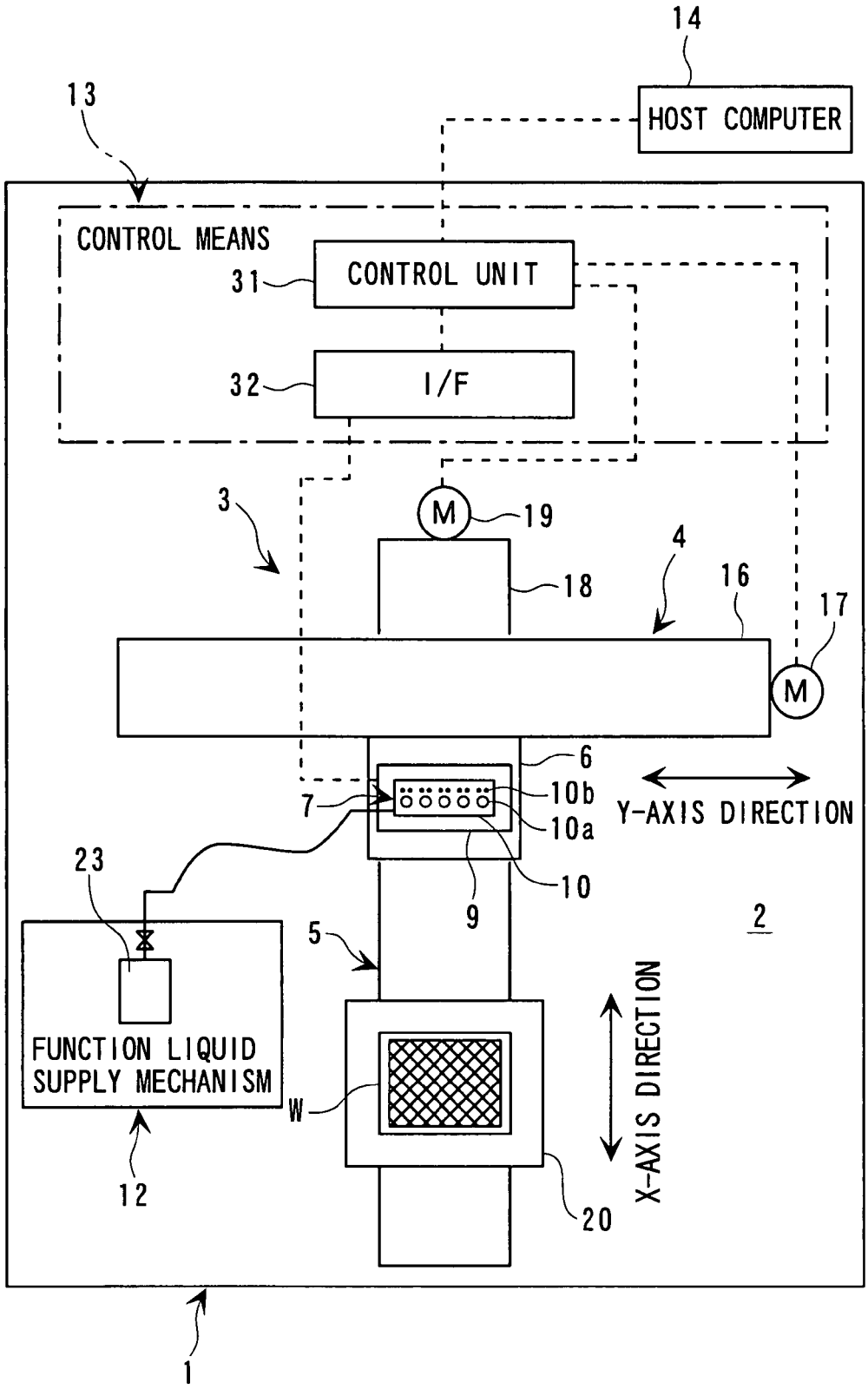
FIG. 1 is a schematic plan view of a function liquid droplet ejection apparatus according to an embodiment of this invention.

As shown in FIG. 1, the function liquid droplet ejection apparatus 1 of the embodiment is made up of: a machine stage 2; an X-axis table 5 and a Y-axis table 4 orthogonal thereto, which constitute a moving mechanism 3 disposed on the machine stage 2; a main carriage 6 which is movably attached to the Y-axis table 4; and a head unit 7 which is mounted on the main carriage 6. As described later in detail, on the head unit 7, a function liquid droplet ejection head 10 is mounted through a sub-carriage 9. Namely, in the function liquid droplet ejection head 10, a plurality of nozzle arrays 10*a*, 10*b* are arranged, which have different function liquid droplet ejection amounts per unit nozzle. Moreover, a substrate W that is a workpiece is mounted on the X-axis table 5.

Furthermore, the function liquid droplet ejection apparatus 1 has built therein: a function liquid supply mechanism 12 which supplies the function liquid droplet ejection head 10 with a function liquid; and control means 13 for controlling the drive of the above-described moving mechanism 3, the function liquid droplet ejection head 10 and the like. In addition, the control means 13 has connected thereto a host computer 14 for generating plural kinds of drive waveform data and ejection pattern data for the function liquid droplet ejection head 10.

The control means 13 has a control unit 31 which integrally controls constituent devices of the function liquid droplet ejection apparatus 1 and is connected to the host computer 14. The control means 13 controls an X-axis motor 19 to drive the X-axis table 5 and controls a Y-axis motor 17 to drive the Y-axis table 4. Moreover, the control means 13 inputs a clock signal (CLK), an ejection signal (SI), a latch signal (LAT) and a drive signal (COM) into the function liquid droplet ejection head 10 through an interface (a second interface: see FIG. 5) 32 and controls the drive of the function liquid droplet ejection head 10. Details of the control means 13 will be described later.

Although not shown, the function liquid droplet ejection apparatus 1 includes: a flushing unit which receives periodic flushing (i.e., waste discharging of the function liquid from all ejection nozzles for the purpose of recovering the function of the nozzles) of the function liquid droplet ejection head 10; a wiping unit which wipes the nozzle surface of the function liquid droplet ejection head 10; a cleaning unit which suctions and stores the function liquid of the function liquid droplet ejection head 10; and the like.

The Y-axis table 4 has a Y-axis slider 16 which is driven by the motor 17 constitutes a drive system of a Y-axis direction. The above-described main carriage 6 is movably mounted on the Y-axis slider 16. Similarly, the X-axis table 5 has an X-axis slider 18 which is driven by the motor 19 included in a drive system of an X-axis direction. A set table 20 made up of a suction table or the like is movably mounted on the X-axis slider 18. On the set table 20, the substrate W is set in position.

In the function liquid droplet ejection apparatus 1 of this embodiment, each of the function liquid droplet ejection heads 10 is driven (to perform selective ejection of the function liquid droplets) in synchronization with the movement thereof by the X-axis table 5. So-called main scanning of the function liquid droplet ejection heads 10 is performed by reciprocating operation of the X-axis table 5 in the X-axis direction. Correspondingly, so-called sub-scanning is performed by reciprocating operation of the substrate W in the Y-axis direction by the Y-axis table 4. The drive (or driving) of the function liquid droplet ejection heads 10 in the scanning described above is performed based on the drive waveform data and ejection pattern data which are created by the aforementioned host computer 14.

The function liquid supply mechanism 12 is made up of: a sub tank 23 which supplies the function liquid droplet ejection heads 10 (the respective nozzle arrays 10*a*, 10*b*) with the function liquid; a main tank (not shown) which is connected to the sub tank 23; and a pressure feed device which feeds the function liquid in the main tank to the sub tank 23. The function liquid in the main tank is fed under pressure to the sub tank 23. That function liquid in the sub tank 23 which is once freed from the influence of the pressure is fed to the function liquid droplet ejection head 10 by a pumping action of the function liquid droplet ejection head 10. Although not shown, the above-described pressure feed device is also controlled by the above-described control means 13.

Figure 2:
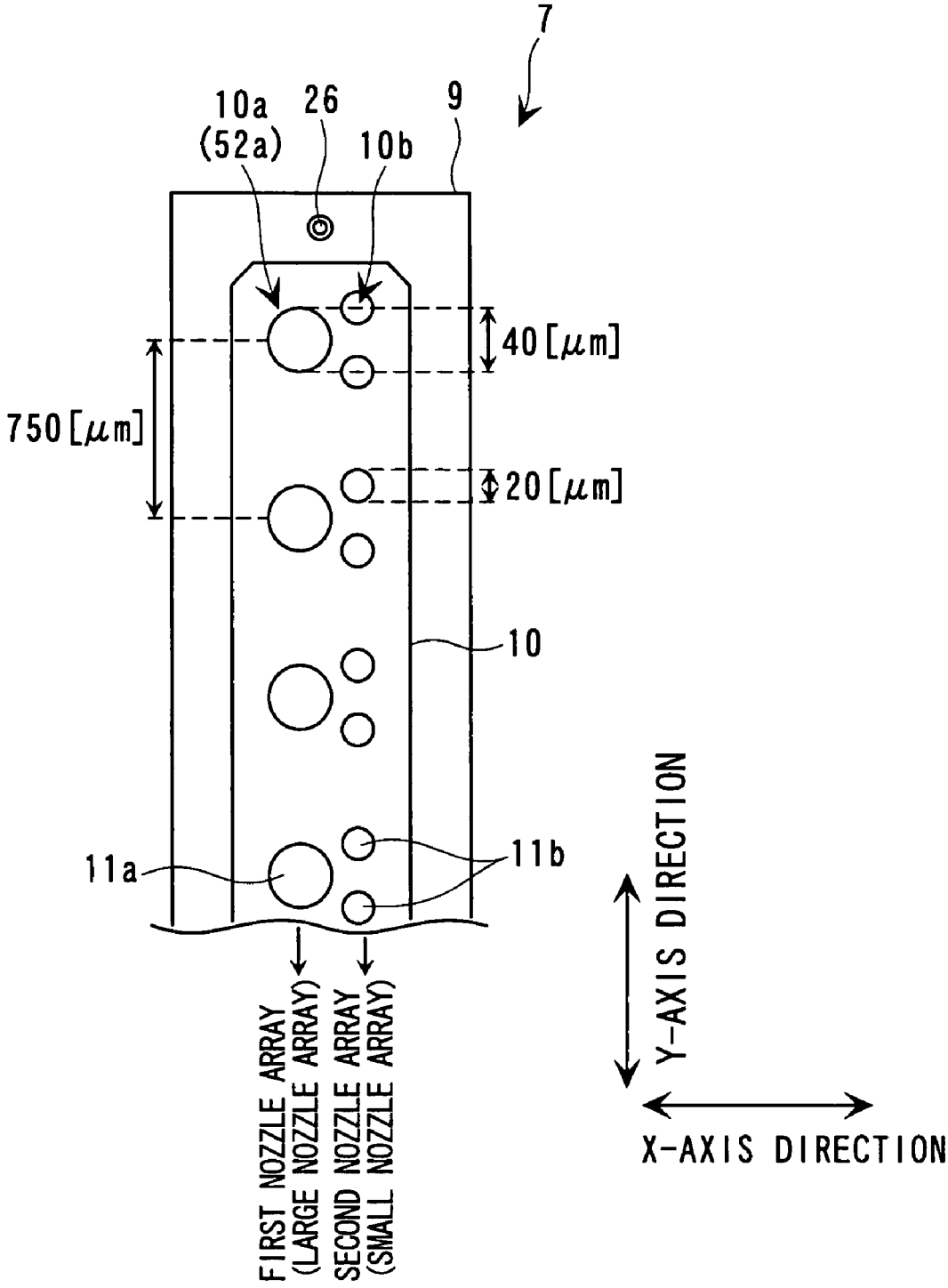
FIG. 2 is a schematic plan view around a function liquid droplet ejection head according to the embodiment.

As shown in FIG. 2, the head unit 7 is made up of: the sub carriage 9 which is formed of a thick plate of stainless steel or the like; and the function liquid droplet ejection head 10 which is accurately positioned on and fixed to the sub carriage 9. Moreover, as a positioning reference of the head unit 7, a pair of reference pins (marks) 26, 26 (only one side is shown) are provided in a widthwise intermediate position of the sub carriage 9 (in the left and right direction thereof as seen in FIG. 2).

In the function liquid droplet ejection head 10, there are disposed a first nozzle array (large nozzle array) 10*a* and a second nozzle array (small nozzle array) 10*b*. The first nozzle array 10*a* has a nozzle orifice diameter of about 40 μm and ejects the function liquid droplets of about 30 to 100 pl. The second nozzle array (small nozzle array) 10*b* has a nozzle orifice diameter of about 20 μm and ejects the function liquid droplets of about 2 to 10 pl. The second nozzle array 10*b* is arranged to have the number of nozzles which is two times that of the first nozzle array 10*a*.

Further, the large nozzles 11*a* and the small nozzles 11*b* are disposed in such a manner that centers of nozzle orifice portions of the small nozzles 11*b* are positioned on lines tangent to both ends of a nozzle orifice portion 52*a* (see FIG. 2) of each of the large nozzles 11*a* as seen in the sub-scanning direction (Y-axis direction). Moreover, the large nozzles 11*a* and the small nozzles 11*b* are also disposed in such a manner that a nozzle interval of the large nozzle array 10*a* in the sub-scanning direction is about 750 μm and a nozzle interval of the small nozzle array 10*b* in the sub-scanning direction (an interval between adjacent set of small nozzles 11*b*, 11*b* close to each of the large nozzles 11*a*) is about 40 μm.

Figure 3:
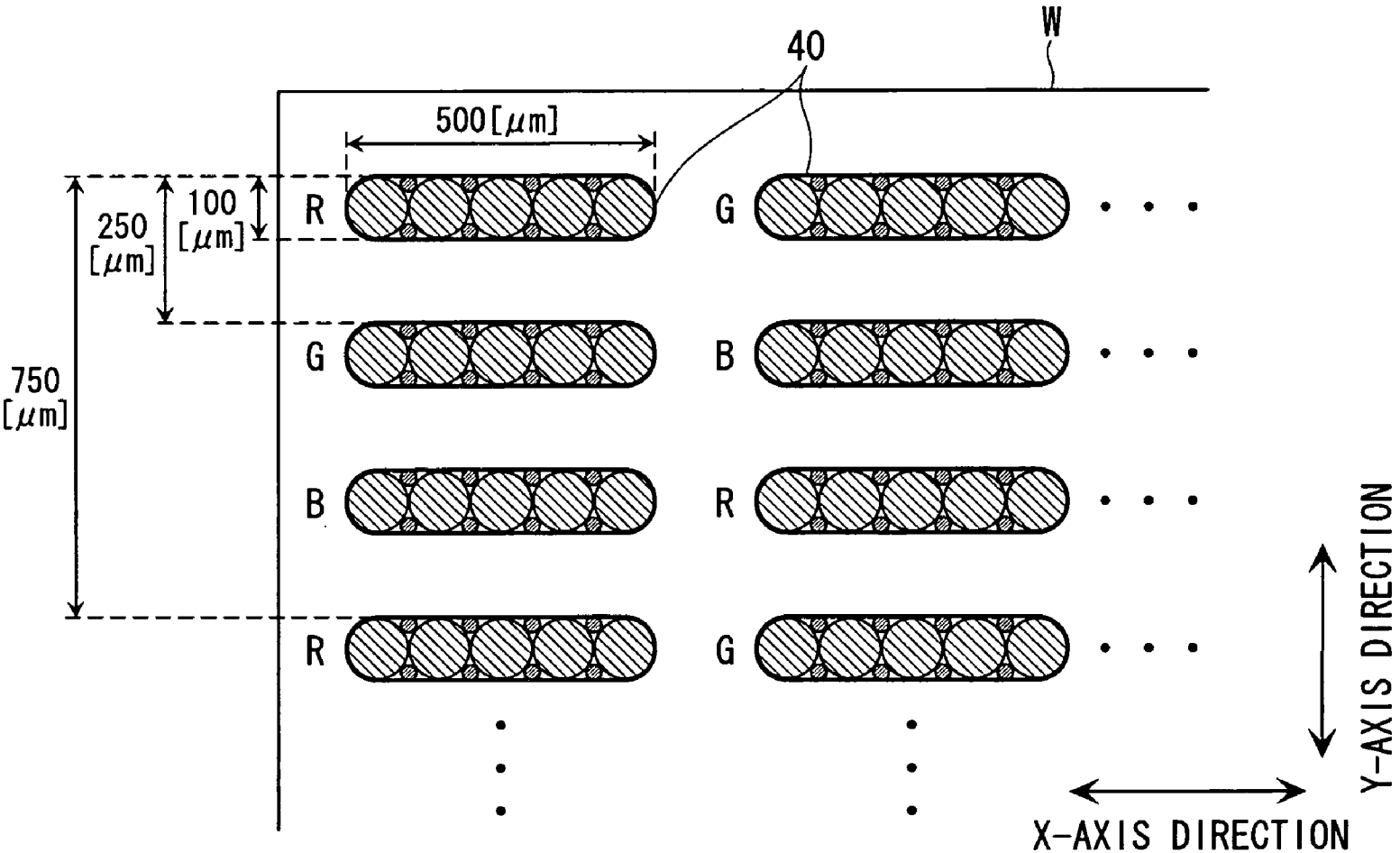
FIG. 3 is a view showing an example of pixels drawn by using the function liquid droplet ejection apparatus according to the embodiment.

Moreover, the above-described function liquid droplet ejection head 10 is disposed in a manner suitable for drawing of the substrate W (pixel group) as shown in FIG. 3. In this case, a pixel has a size of 100 μm in the sub-scanning direction. In other words, when function liquid droplets are caused to travel to, or hit, the target from the small nozzles 11*b* having the nozzle interval of about 40 μm, the pixel is required to have a size that allows function liquid droplets ejected from two of the small nozzles 11*b* to reach sufficiently within the pixel 40. Moreover, when a length of the pixel 40 in the main scanning direction is 500 μm, it is preferable to control the drive of the function liquid droplet ejection head 10 so as to eject five shots of function liquid droplets from the large nozzle 11*a* and eight shots thereof from the small nozzle 11*b* to one pixel 40. Thus, the use of the two large and small nozzle arrays 10*a*, 10*b* having different diameters exhibits an advantage. Consequently, a uniform film thickness can be obtained efficiently within the pixel 40 (while improving printing throughput).

Further, as shown in FIG. 3, in the case of drawing the pixel group including the pixels 40 of three colors, R (red), G (green) and B (blue), it is preferable that the nozzle interval of the large nozzle 11*a* in the sub-scanning direction be arranged to be equal to a pitch 750 μm between pixels of the same color. Thus, more efficient drawing can be performed. When the function liquid droplet ejection apparatus 1 as shown in FIG. 1 ejects function liquid droplets of R (red), drawing in G (green) and B (blue) is performed after respective firing steps are finished.

Next, with reference to FIG. 4, a mechanical structure of the function liquid droplet ejection head 10 will be described.

Figure 4:
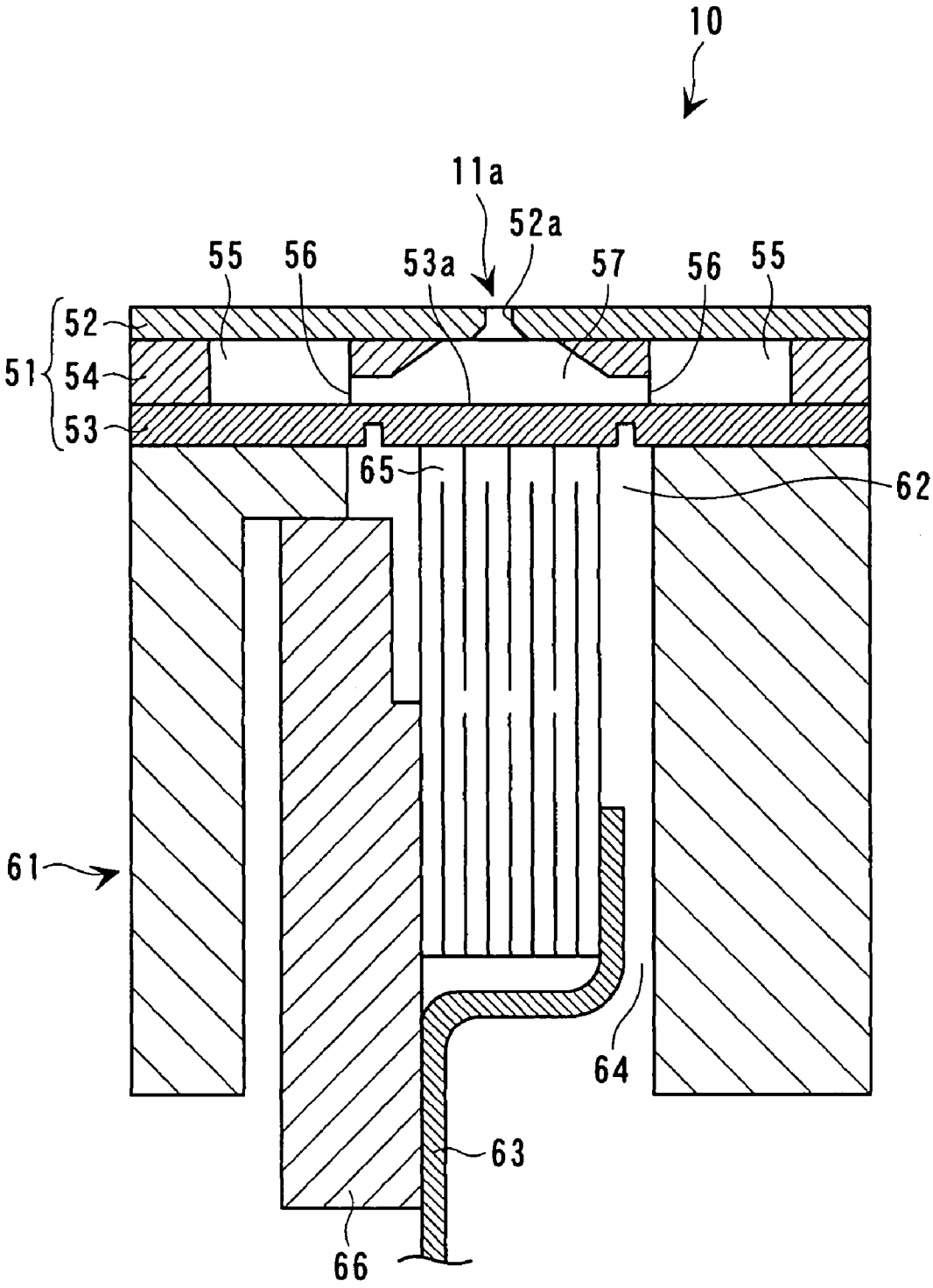
FIG. 4 is a cross-sectional view showing a mechanical structure of the function liquid droplet ejection head according to the embodiment.

FIG. 4 is a view showing a cross-section of the large nozzle 11*a* arranged in the function liquid droplet ejection head 10. The function liquid droplet ejection head 10 is made up of: a substrate unit 51 which forms an ink passage; and a base 61 to which a piezoelectric oscillator 65 is attached.

The substrate unit 51 is arranged by sandwiching a passage-forming plate 54 by a nozzle plate 52, in which the nozzle orifice portion 52*a* is formed, and an oscillating plate 53, in which an island portion 53*a* is formed. In the passage-forming plate 54, there are formed: a through-hole which defines a pressure generating chamber (cavity) 57; through-holes which define two ink supply ports 56 communicating with both sides of the pressure generating chamber 57; and through-holes which define two ink chambers 55 communicating with the ink supply ports 56. The oscillating plate 53 is formed of an elastically deformable thin plate and fixed to a tip of the piezoelectric oscillator (pressure generating element) 65. As the piezoelectric oscillator 65, a piezoelectric element (PZT) capable of extremely high-speed electric-to-mechanical energy conversion is used in which a crystal structure of the piezoelectric element is distorted by application of a voltage.

On the other hand, the base 61 is made up of: a housing chamber 64 which houses the piezoelectric oscillator 65 in a manner that can be oscillated; and an opening 62 which supports the substrate unit 51. The piezoelectric oscillator 65 is fixed by means of a fixed substrate 66 in a state in which the tip of the piezoelectric oscillator 65 is exposed from the opening 62. Moreover, the base 61 assembles the function liquid droplet ejection head 10 by fixing the substrate unit 51 to the opening 62 in a state in which the island portion 53*a* of the oscillating plate 53 comes into contact with the piezoelectric oscillator 65. Charge and discharge of the piezoelectric oscillator 65 are performed through a flexible print cable (FPC) 63.

According to the above-described arrangement, a drive pulse of a drive signal (COM), to be described later, is applied to the piezoelectric oscillator 65 to thereby contract the piezoelectric oscillator 65 and expand the pressure generating chamber 57. Thus, ink in the common ink chambers 55 flows into the pressure generating chamber 57 through the ink supply ports 56. Thereafter, the piezoelectric oscillator 65 is discharged so as to be elongated after a predetermined period of time and the pressure generating chamber 57 is contracted. Consequently, the function liquid in the pressure generating chamber 57 is compressed and function liquid droplets are ejected to the outside from the nozzle orifice portion 52*a*. Subsequently, when the piezoelectric oscillator 65 is contracted again and the pressure generating chamber 57 is expanded, new ink in the ink chambers 55 flows into the pressure generating chamber 57 from the ink supply ports 56.

The piezoelectric oscillator 65 may be a piezoelectric element of a flexible oscillation type, instead of a piezoelectric element of longitudinal oscillation and transverse effect. Moreover, as the pressure generating element, an element of magnetostriction type or the like may be used, instead of the piezoelectric oscillator 65. Moreover, there may also be used a so-called bubble jet (ejection) method in which liquid droplets are pressurized and ejected by bubbles generated by heating. In other words, any elements can be used instead as long as the elements cause pressure fluctuations in the pressure generating chamber 57 in accordance with signals to be applied.

Although the cross-section of the large nozzle 11*a* is shown here, a cross-section of the small nozzle 11*b* has the similar structure. However, the small nozzle 11*b* is different from the large nozzle 11*a* in an opening diameter of the nozzle orifice portion 52*a*. Thus, both the volume of the pressure generating chamber (cavity) and the capacity of the piezoelectric element (pressure generating element) 65 are set to be small.

Figure 5:
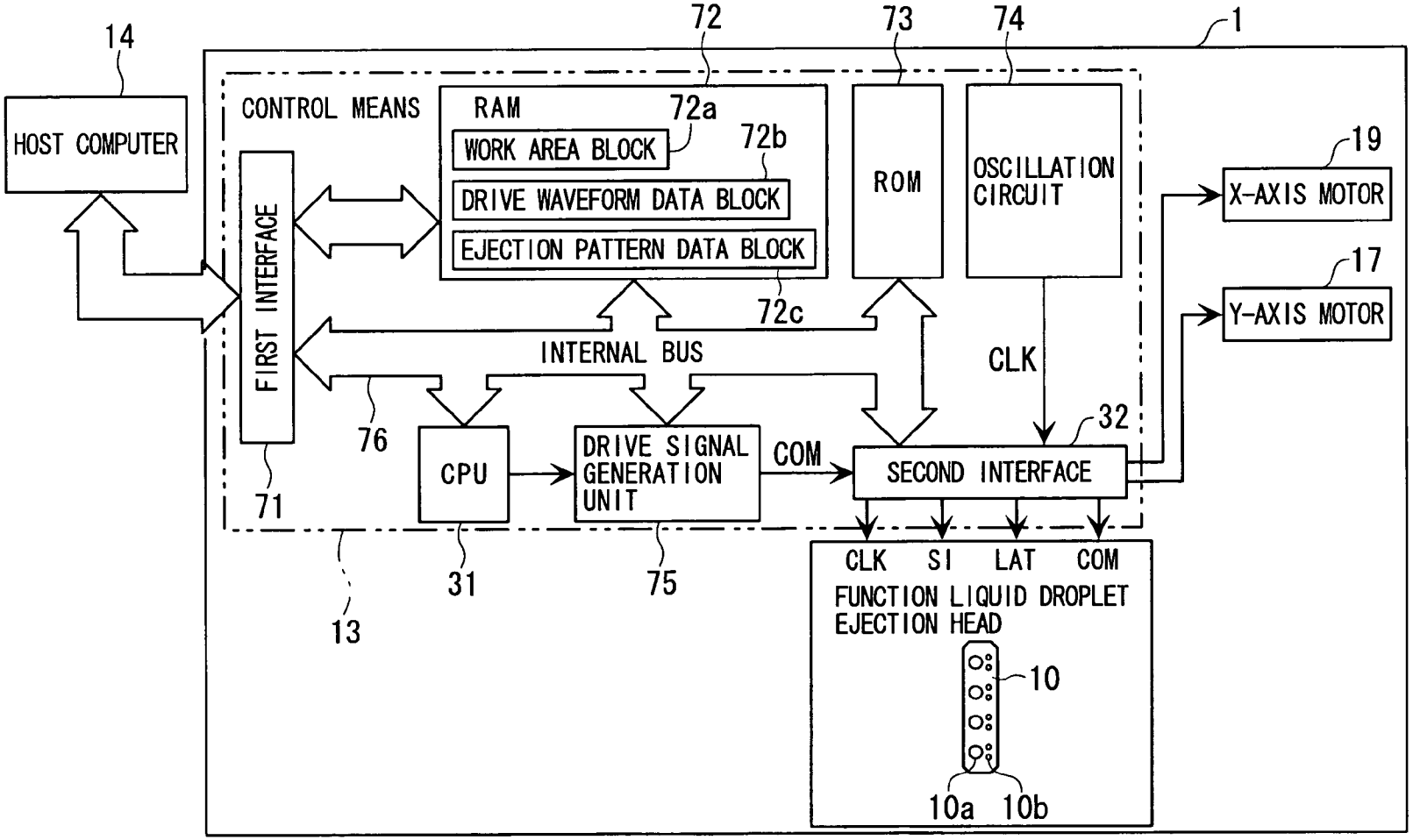
FIG. 5 is a block diagram showing a control configuration of the function liquid droplet ejection apparatus according to the embodiment.

Next, an arrangement of control of the function liquid droplet ejection apparatus 1 will be described with reference to a functional block diagram in FIG. 5. As shown in FIG. 5, the control means 13 is made up of: a first interface 71 which acquires various instructions, drive waveform data and ejection pattern data from the host computer 14; a RAM 72 which is used as a work area for control processing; a ROM 73 which stores a control program for the control processing and control data including various tables; an oscillation circuit 74 which generates clock signals (CLK); a drive signal generation unit 75 which generates drive signals (see FIG. 9) for driving the function liquid droplet ejection head 10; the second interface 32 for sending data signals, drive signals and the like to the X-axis and Y-axis motors 19 and 17 which constitute the moving mechanism 3, as well as to the function liquid droplet ejection head 10; and a CPU 31 which controls the respective parts connected through an internal bus 76.

The RAM 72 is made up of: various work area blocks 72*a* which are used as flags and the like; a drive waveform data block 72*b* which stores the drive waveform data transmitted from the host computer 14; and an ejection pattern data block 72*c* which stores the ejection pattern data similarly transmitted from the host computer 14. The RAM 72 is backed up all the time so as to retain the stored data even when the power is cut off.

The CPU 31 receives inputs in the form of various signals and data from the host computer 14 through the first interface 71 and processes the various data in the RAM 72 in accordance with the control program in the ROM 73. The CPU 31 further sends various signals to the drive signal generation unit 75 and controls generation of drive waveforms for controlling the drive of the function liquid droplet ejection head 10.

Figure 6:
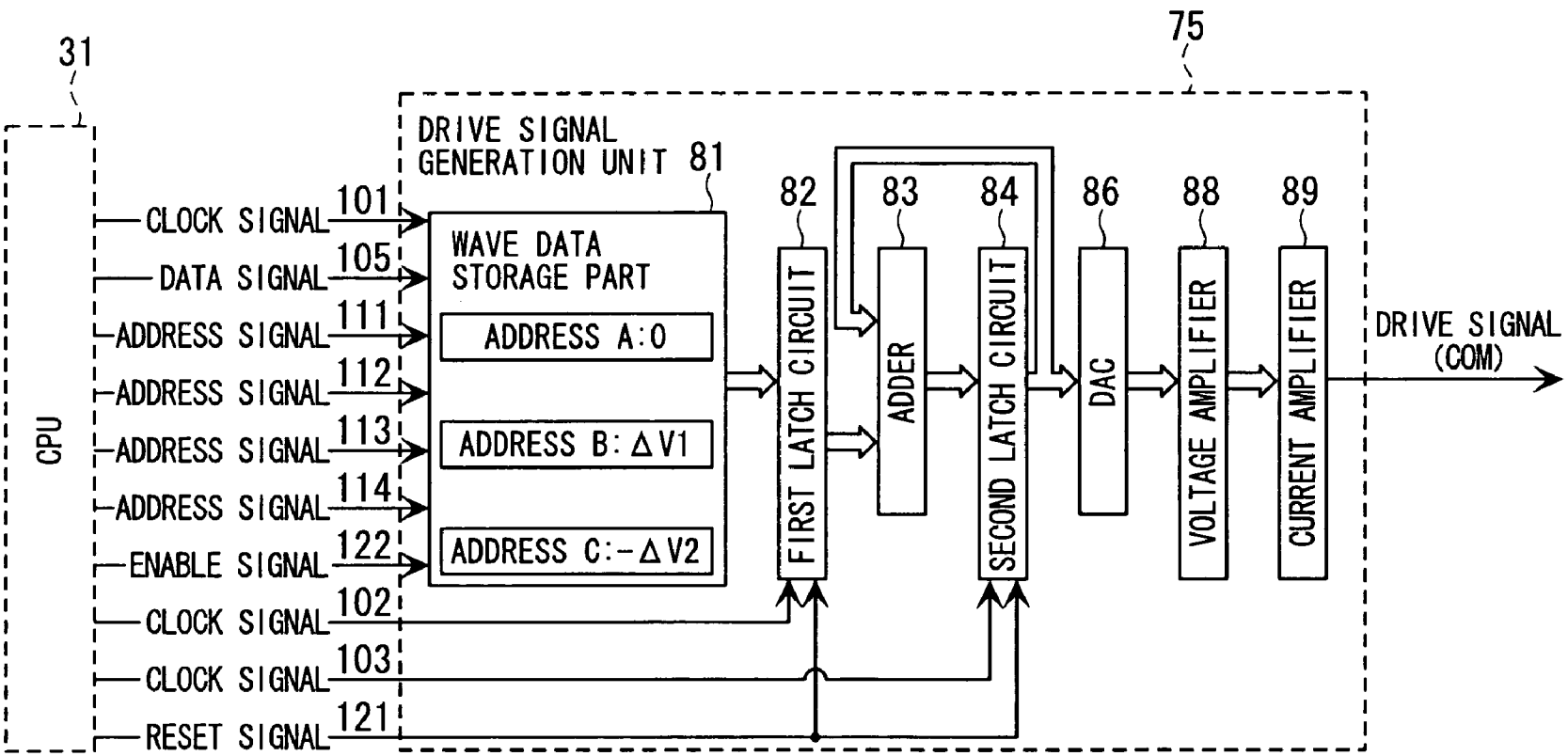
FIG. 6 is a block diagram showing an internal configuration in a drive signal generation unit of the function liquid droplet ejection apparatus according to the embodiment.

An internal arrangement of the drive signal generation unit 75 will now be described with reference to a functional block diagram in FIG. 6. The drive signal generation unit 75 is made up of: a waveform data storage part 81 which stores drive waveform data inputted from the CPU 31; a first latch circuit 82 which temporarily retains the drive waveform data read out from the waveform data storage part 81; an adder 83 which adds an output of the first latch circuit 82 and an output of a second latch circuit 84 to be described later; the second latch circuit 84; a digital/analog converter (DAC) 86 which converts the output of the second latch circuit 84 into an analog signal; a voltage amplifier 88 which amplifies the converted analog signal up to a voltage for operating the piezoelectric element 65; and a current amplifier 89 for performing current supply corresponding to an amplified voltage signal.

The waveform data storage part 81 stores, as waveform data, predetermined parameters for determining waveforms of drive signals (COM). Therefore, the waveforms of the drive signals are determined by predetermined parameters (clock signals 101 to 103, a data signal 105, address signals 111 to 114, a reset signal 121 and an enable signal 122) which are previously received from the CPU 31. In other words, in the drive signal generation unit 75, prior to generation of the drive signals (COM), a plurality of data signals 105 indicating a voltage change amount and address signals 111 to 114 indicating addresses of the data signals 105 are outputted from the CPU 31 to the waveform data storage part 81 in synchronization with the clock signal 101 (for data signal transmission). In the waveform data storage part 81, the received data (the voltage change amount) is written in the addresses indicated by the address signals 111 to 114. Here, it is assumed that a voltage change amount 0 is written in an address A, that a voltage change amount ΔV1 is written in an address B, and that a voltage change amount −ΔV2 is written in an address C. Since the address signals 111 to 114 are 4-bit signals, up to 16 kinds of voltage change amounts can be stored in the waveform data storage part 81. Moreover, the most significant bit of the data of each address is used as a sign (+ or −) indicating an increase or a decrease in the voltage change amount.

Figure 7:
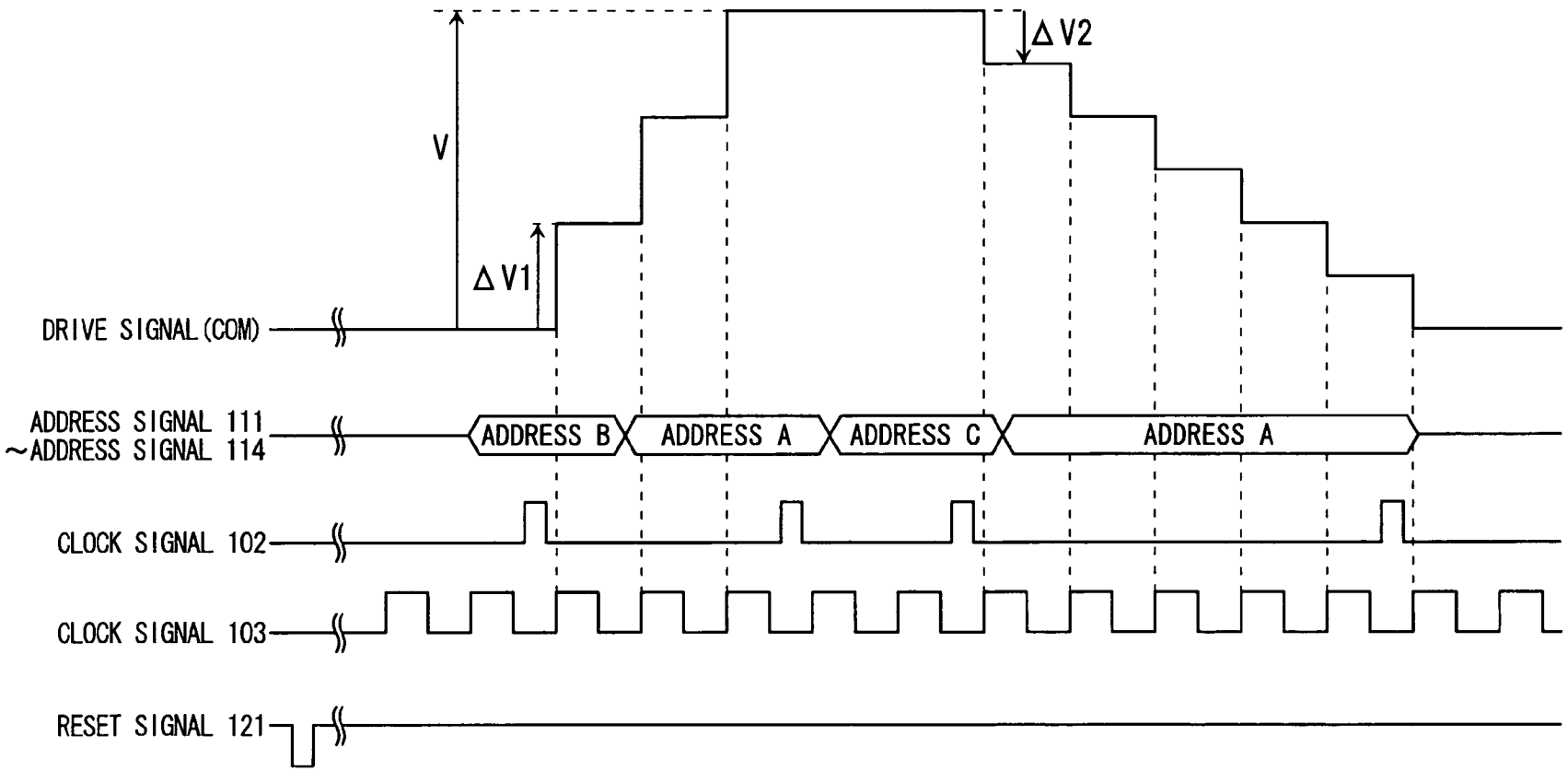
FIG. 7 is a view showing a process of generating a drive waveform in the drive signal generation unit of the function liquid droplet ejection apparatus according to the embodiment.

When setting of the voltage change amounts in the respective addresses (addresses A to C) is finished and the address B is outputted to the address signals 111 to 114 as shown, e.g., in FIG. 7, the voltage change amount ΔV1 corresponding to the address B is retained in the first latch circuit 82 by the first clock signal 102. In this state, when the clock signal 103 is outputted, a value obtained by adding output of the first latch circuit 82 to output of the second latch circuit 84 is retained in the second latch circuit 84. In other words, once the voltage change amount corresponding to the address signals 111 to 114 is selected, the output of the second latch circuit 84 is increased or decreased each time the clock signal 103 is outputted.

Therefore, when the address A is outputted to the address signals 111 to 114, the voltage change amount 0 (voltage maintained) corresponding to the address A is retained in the first latch circuit 82 by the first clock signal 102. Thus, the waveform of the drive signal is maintained in a flat state. Thereafter, when the address A is outputted to the address signals 111 to 114 and the voltage change amount −ΔV2 is retained in the first latch circuit 82 by the first clock signal 102, the voltage is lowered by ΔV2 in accordance with the output of the clock signal 103.

Figure 9:
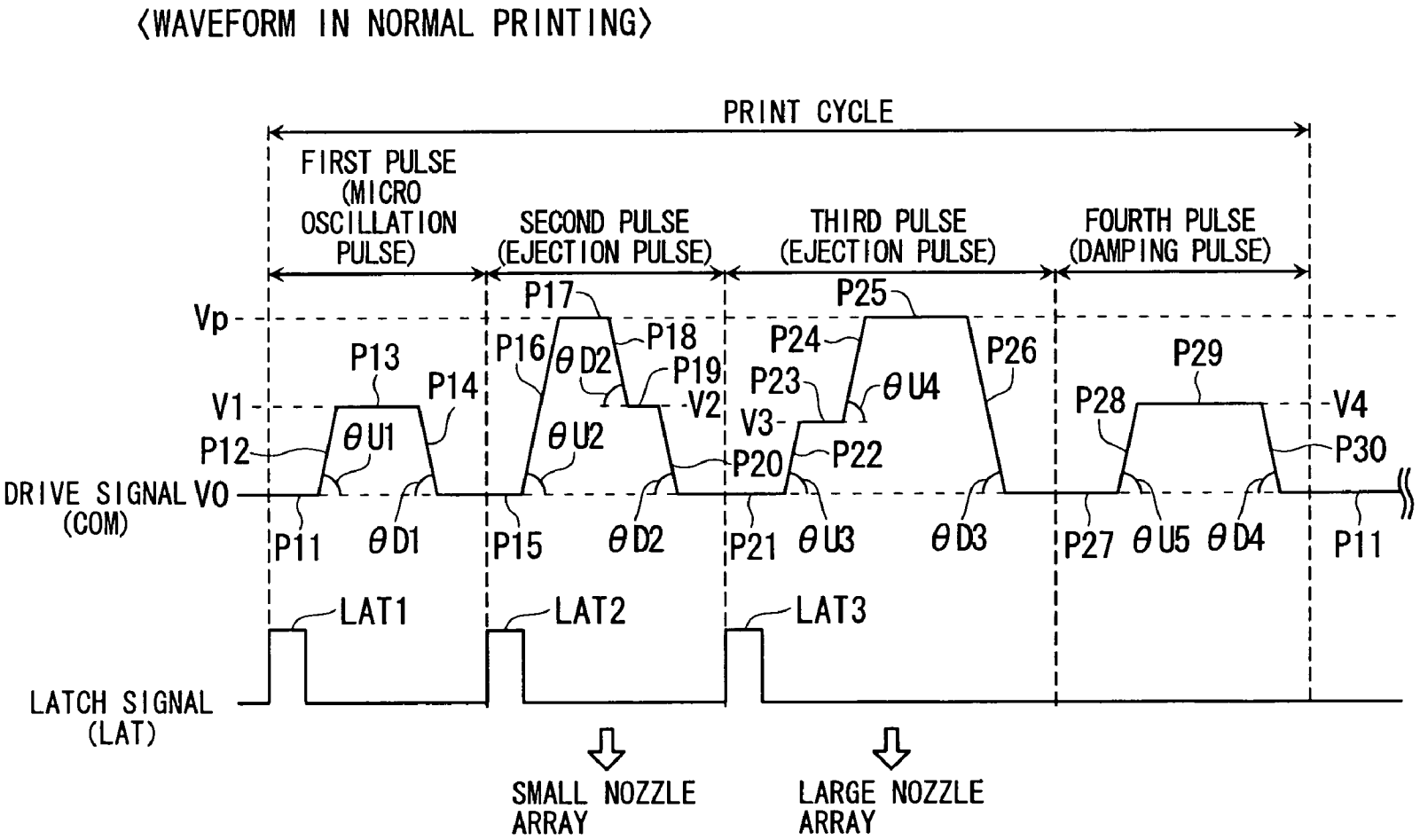
FIG. 9 is a waveform chart showing a drive signal in normal printing according to the embodiment.

As described above, by thus outputting the address signals 111 to 114 and the clock signals 102 and 103 are outputted from the CPU 31, the waveform of the drive signal (COM) can be freely selected. In this embodiment, as shown in FIG. 9, a drive signal having four drive pulses within one ejection cycle is generated.

Figure 8:
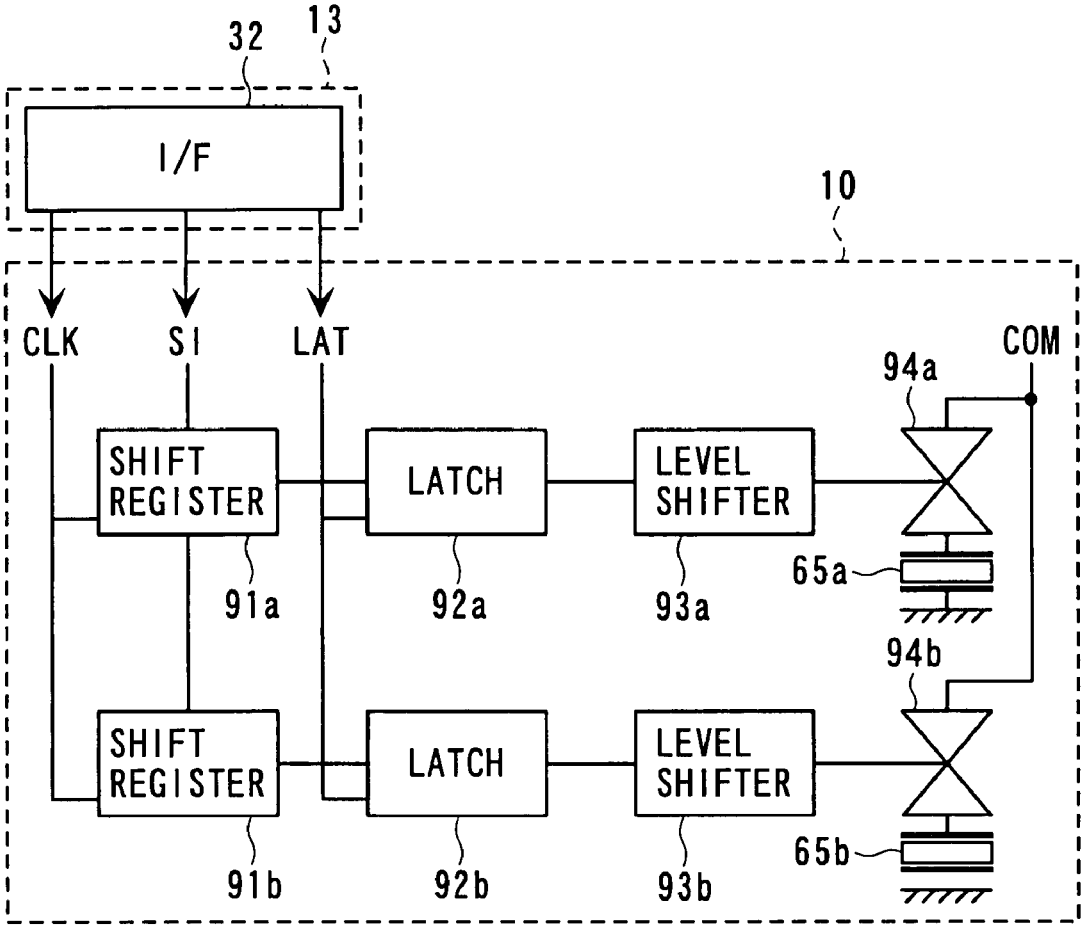
FIG. 8 is a block diagram showing an electrical configuration of the function liquid droplet ejection head according to the embodiment.

Next, an electrical arrangement of the function liquid droplet ejection head 10 will be described with reference to a block diagram in FIG. 8. The function liquid droplet ejection head 10 is made up of: a plurality of shift registers 91*a*, 91*b* corresponding to the number of the nozzles 11*a*, 11*b* (here, only two shift registers corresponding to the large nozzle 11*a* and the small nozzle 11*b* are shown); a plurality of latch circuits 92*a*, 92*b*; a plurality of level shifters 93*a*, 93*b*; a plurality of switching circuits 94*a*, 94*b*; and a plurality of piezoelectric elements 65*a*, 65*b*. An ejection signal (SI) is inputted to the shift registers 91*a*, 91*b* through the second interface 32 in synchronization with a clock signal (CLK) from the oscillation circuit 74. Thereafter, the ejection signal is latched by the latch circuits 92*a*, 92*b* in synchronization with a latch signal (LAT) similarly inputted through the second interface 32. The latched ejection signal (SI) is amplified by the level shifters 93*a*, 93*b* up to a voltage capable of driving the switching circuits 94*a*, 94*b* and is subsequently supplied to the switching circuits 94*a*, 94*b*. The drive signal (COM) from the drive signal generation unit 75 is inputted to input sides of the switching circuits 94*a*, 94*b* and the piezoelectric elements 65*a*, 65*b* are connected to output sides thereof.

When the ejection signal (SI) is "1", the switching circuits 94*a*, 94*b* supply the drive signal (COM) to the piezoelectric elements 65*a*, 65*b* to operate them. When the ejection signal (SI) is "0", on the other hand, the switching circuits 94*a*, 94*b* shut off the supply of the drive signal and do not operate the piezoelectric elements. Therefore, in the case of driving the function liquid droplet ejection head 10 by means of a drive signal including four drive pulses shown in FIG. 9, waveforms of first to fourth pulses can be arbitrarily selected by using the latch signal (LAT) obtained by latching the ejection signal (SI).

Next, the respective drive pulses constituting the drive signal (COM) will be described with reference to a waveform chart in FIG. 9. As shown in FIG. 9, in one print cycle, the drive signal (COM) in normal printing is made up of: the first pulse (micro oscillation pulse) which is inputted as countermeasures against thickening of the function liquid; the second pulse (ejection pulse) which is inputted to eject function liquid droplets from the small nozzle array 10*b*; the third pulse (ejection pulse) which is inputted to eject function liquid droplets from the large nozzle array 10*a*; and the fourth pulse (damping pulse) which is inputted to damp residual oscillation of the pressure generating element (piezoelectric element) 65.

The first pulse (micro oscillation pulse) is a waveform in which only one waveform is inputted in one print cycle. A voltage of a degree not to eject function liquid droplets from the respective nozzles 11*a*, 11*b* is applied to the first pulse. The waveform thereof starts from a potential V0 (P11), rises from the potential V0 at a predetermined voltage gradient ΘU1 (P12) and maintains a maximum potential V1 which is smaller than a maximum potential Vp for a predetermined period of time (P13). Thereafter, the waveform declines to the potential V0 at a voltage gradient ΘD1 which is approximately equal to the voltage gradient ΘU1 in rising (in charging) (P14). Here, the waveform of the micro oscillation pulse and the maximum potential V1 thereof are determined according to the kind of the function liquid droplets. In this manner, by inputting the micro oscillation pulse, the function liquid which forms the meniscus of the respective nozzles 11*a*, 11*b* is oscillated, whereby it is possible to prevent the function liquid in the vicinity of the nozzle orifice portion 52*a* from increasing in viscosity. Therefore, a good ejection state of the function liquid can be maintained.

Further, since only one waveform of the micro oscillation pulse is inputted in one cycle regardless of the number of ejection pulses to be inputted later, influences on the printing throughput can be reduced. Namely, in the case of driving the two nozzle arrays 10*a*, 10*b* which have different function liquid droplet ejection amounts (nozzle orifice diameters) per unit nozzle, the nozzle arrays are generally driven by using independent drive signals (2COM), respectively. In such a case, micro oscillation pulses are required for the respective drive signals. However, in this embodiment, the two nozzle arrays 10*a*, 10*b* which have different function liquid droplet ejection amounts per unit nozzle are driven by using a single drive signal. Thus, a common drive signal can be shared therebetween, resulting in shortening of the print cycle (improvement in the printing throughput). Moreover, the micro oscillation pulse is inputted before the ejection pulse (the second pulse and the third pulse) to be described later. Thus, also at the time of inputting the first ejection pulse, a normal function liquid which is free from thickening can be ejected.

Next, the second pulse (ejection pulse) is a waveform inputted to eject function liquid droplets from the small nozzle array 10*b*. A voltage value thereof maintains the voltage V0 for a predetermined period of time (P15) after the first pulse is inputted and rises at a predetermined voltage gradient ΘU2 (P16). Subsequently, the voltage value rises up to the maximum potential Vp and maintains the maximum potential Vp for a predetermined period of time (P17). Thereafter, the voltage value declines at a predetermined voltage gradient ΘD2 (P18).

The voltage value of the second pulse declines to a potential V2 (P18) and maintains the potential V2 for a predetermined period of time (P19). Thereafter, the voltage value declines to the potential 0 at the same voltage gradient ΘD2 again (P20). A retention time of the potential V2 (P19) is for regulating timing of movement of the function liquid in the pressure generating chamber (cavity) 57. Thus, it is possible to prevent unstable ejection of function liquid droplets.

Next, the third pulse (ejection pulse) is a waveform inputted to eject function liquid droplets from the large nozzle array 10*a*. A voltage value thereof maintains the voltage V0 for a predetermined period of time (P21) after the second pulse is inputted and rises at a predetermined voltage gradient ΘU3 (P22). Subsequently, the voltage value rises up to a potential V3 and maintains the potential V3 for a predetermined period of time (P23). Thereafter, the voltage value rises again at a voltage gradient ΘU4 (P24). Similar to the retention time of the potential V2 of the second pulse (P19), a retention time of the potential V3 is for regulating the timing of movement of the function liquid in the pressure generating chamber 57. Subsequently, the voltage value of the third pulse rises up to the maximum potential Vp and maintains the maximum potential Vp for a predetermined period of time (P25). Thereafter, the voltage value declines at a predetermined voltage gradient ΘD3 (P26).

Moreover, the voltage gradients ΘU3, ΘD3 of the third pulse are smaller than the voltage gradients ΘU2, ΘD2 of the second pulse. Furthermore, the maximum potential Vp retention time (P25) of the third pulse is longer than the maximum potential Vp retention time (P17) of the second pulse. The conditions are determined in accordance with the respective function liquid droplet ejection amounts per unit nozzle of the large and small nozzles 11*a*, 11*b*, the volume of the pressure generating chamber (cavity) 57, and the capacity of the piezoelectric element (pressure generating element) 65. In other words, since the function liquid droplet ejection amount per unit nozzle of the large nozzle 11*a* is larger than that of the small nozzle 11*b*, both the volume of the pressure generating chamber (cavity) 57 and the capacity of the piezoelectric element (pressure generating element) 65 become larger. Thus, as compared with the small nozzle 11*b*, the voltage gradient is reduced to suction the liquid more slowly into the pressure generating chamber 57 from the ink chambers 55, and the potential is maintained until the liquid is sufficiently suctioned into the pressure generating chamber 57 (the retention time P25). Similarly, the liquid is ejected in an ejection waveform (P26) whose voltage gradient is made smaller than that of the small nozzle 11*b*. As described above, in this embodiment, the waveforms of the ejection pulses are changed in accordance with specifications of the respective nozzle arrays 10*a*, 10*b*. Thus, it is possible to use nozzles having various specifications (the nozzle orifice diameter, the shape of the nozzle orifice and the like). In addition, function liquids of various weights or viscosities can be ejected. Although both the maximum potentials of the second and third pulses are set to Vp, the maximum potential need not always be a common potential.

Next, the fourth pulse (damping pulse) is a waveform inputted to damp the residual oscillation of the pressure generating element 65. A voltage value thereof maintains the voltage V0 for a predetermined period of time (P27) after the third pulse is inputted and rises at a predetermined voltage gradient ΘU5 (P28). Subsequently, the voltage value rises up to a maximum potential V4 and maintains the maximum potential V4 for a predetermined period of time (P29) and, thereafter, declines at a voltage gradient ΘD4 (P30).

Further, the waveform and the maximum voltage value V4 of the damping pulse are determined in accordance with the waveform of the last inputted ejection pulse, i.e., the third pulse. Moreover, a head drive cycle and the ejection waveform determine whether damping is required (this embodiment shows an example in which damping is required). In this manner, by inputting the damping pulse, it is possible to damp or weaken the residual oscillation of the pressure generating element (piezoelectric element) 65, the residual oscillation being remained after the third pulse is inputted. Therefore, the input of the damping pulse makes it possible to always perform stable ejection of the function liquid without imposing influences of the third pulse on the next drive pulse. Moreover, the damping pulse has a waveform corresponding to the waveform of the ejection pulse that is inputted immediately before. Thus, the residual oscillation can be damped more surely.

Waveform selection of the first through fourth pulses will now be described. As described above, in the waveforms of the first through fourth pulses, ejection "1" or non-ejection "0" can be arbitrarily selected by using the latch signal (LAT) obtained by latching the ejection signal (SI) (see FIG. 8). Therefore, when "1" is selected by the latch signal before the first pulse is inputted, the first pulse is inputted. When "0" is selected by the latch signal, the first pulse is not inputted. The same processing applies to the second and third pulses. Moreover, ejection or non-ejection of the fourth pulse is determined according to ejection "1" or non-ejection "0" of the third pulse. Namely, the fourth pulse is for damping the residual oscillation of the piezoelectric element 65, which remains after the third pulse is inputted. Therefore, no latch signal is generated before input of the fourth pulse and, thus, ejection or non-ejection of the fourth pulse is determined according to ejection or non-ejection of the third pulse.

In this embodiment, the second pulse has the waveform inputted to the small nozzle 11*b* and the third pulse has the waveform inputted to the large nozzle 11*a*. Consequently, the second pulse is always set to non-ejection "0" for the large nozzle 11*a* and the third pulse is always set to non-ejection "0" for the small nozzle 11*b*.

Further, the drive signal shown in FIG. 9 is one when the function liquid droplet ejection head 10 is moved forward. The waveform thereof differs when the function liquid droplet ejection head 10 is moved backward. Namely, in the backward movement, the first pulse, the third pulse, the second pulse and the fourth pulse are inputted in the order mentioned. The ejection or non-ejection of the fourth pulse is determined according to ejection or non-ejection of the second pulse which is inputted immediately before the fourth pulse. In addition, the fourth pulse has a waveform corresponding to that of the second pulse.

Moreover, in this case, waveform switching is performed when the carriage is returned (when the backward movement is started). The waveform switching is performed in the following manner. Namely, the voltage value is lowered to the potential V0 (lowest potential) and the value of the DAC 86 (see FIG. 6) is set to 0 (reset). Thereafter, different data (voltage change amount) is written in the address again in the waveform data storage part 81. Subsequently, the DAC 86 is operated again.

As described above, in this embodiment, only when the carriage is returned (only in the case of performing reciprocating printing), the waveform switching is performed. In other cases, the waveform switching is not required. Thus, the printing throughput can be improved. Namely, in the case of controlling the two nozzle arrays, which have different function liquid droplet ejection amounts per unit nozzle, by switching the drive signal without driving by using two drive signals, time for switching the drive signal is required each time the drive signal is inputted. In this embodiment, on the other hand, a single drive signal includes ejection pulses corresponding to the respective nozzle arrays 10*a* and 10*b*. Thus, the time for switching is not required each time the drive signal is inputted. Consequently, the printing throughput can be improved accordingly.

Next, the drive signal (COM) in flushing will be described with reference to a waveform chart in FIG. 10. The flushing is processing for function recovery, and the function liquid is thus discharged (preliminarily in a wasting manner; also called waste discharging) from all the nozzles at the time of starting the printing and on a regular basis in order to prevent the function liquid from getting thicker (or larger) in viscosity. Therefore, the flushing does not require fine adjustment of the amount of function liquid droplets to be ejected or high ejection accuracy. Thus, in the flushing, the function liquid is ejected in a drive waveform common to both the large and small nozzles 11*a*, 11*b*.

Figure 10:
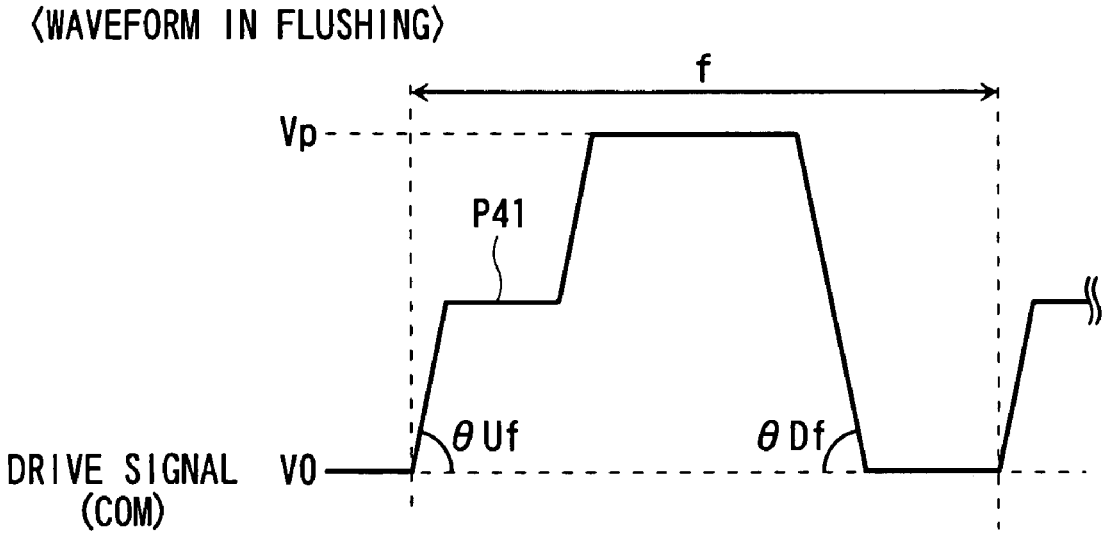
FIG. 10 is a waveform chart showing a drive signal in flushing according to the embodiment.

As shown in FIG. 10, the drive signal in the flushing has a waveform similar to that of the above-described third pulse (ejection pulse). A flat portion (voltage retention portion: P41) in voltage rise (in charging) is for regulating timing of movement of the function liquid in the pressure generating chamber 57. In this manner, in the flushing, by driving the large and small nozzles 11*a*, 11*b* by using the common drive waveform, the print cycle is shortened. Thus, high-frequency drive is made possible. The large nozzle 11*a* and the small nozzle 11*b* are different in the diameter of the nozzle orifice portion 52*a* and the capacity of the piezoelectric element 65. Thus, as a matter of course, both the nozzles are different in the amount of the function liquid to be ejected in flushing. A larger amount of the function liquid is subjected to waste discharging from the large nozzle 11*a* than from the small nozzle 11*b*.

By the way, the function liquid droplet ejection apparatus 1 of this embodiment which is arranged as described above can be used to manufacture various electro-optic devices. Now, with reference to FIGS. 11 to 23, an organic EL device (organic EL display device) and a manufacturing method thereof will be described as an example of the electro-optic device.

FIGS. 11 to 23 show a manufacturing process of the organic EL device including an organic EL element as well as a structure of the organic EL device. The manufacturing process is made up of: a bank part formation step; a plasma processing step; a light-emitting element formation step including a hole injection/transport layer formation step and a luminescent layer formation step; a counter electrode formation step; and a sealing step.

In the bank part formation step, at predetermined positions on a circuit element part 502 and electrodes 511 (also referred to as pixel electrodes), which are formed in advance on a substrate 501, an inorganic bank layer 512*a* and an organic bank layer 512*b* are laminated. Thus, a bank part 512 having an opening portion 512*g* is formed. As described above, the bank part formation step includes: a step of forming the inorganic bank layer 512*a* on a part of the electrode 511; and a step of forming the organic bank layer 512*b* on the inorganic bank layer.

Figure 11:
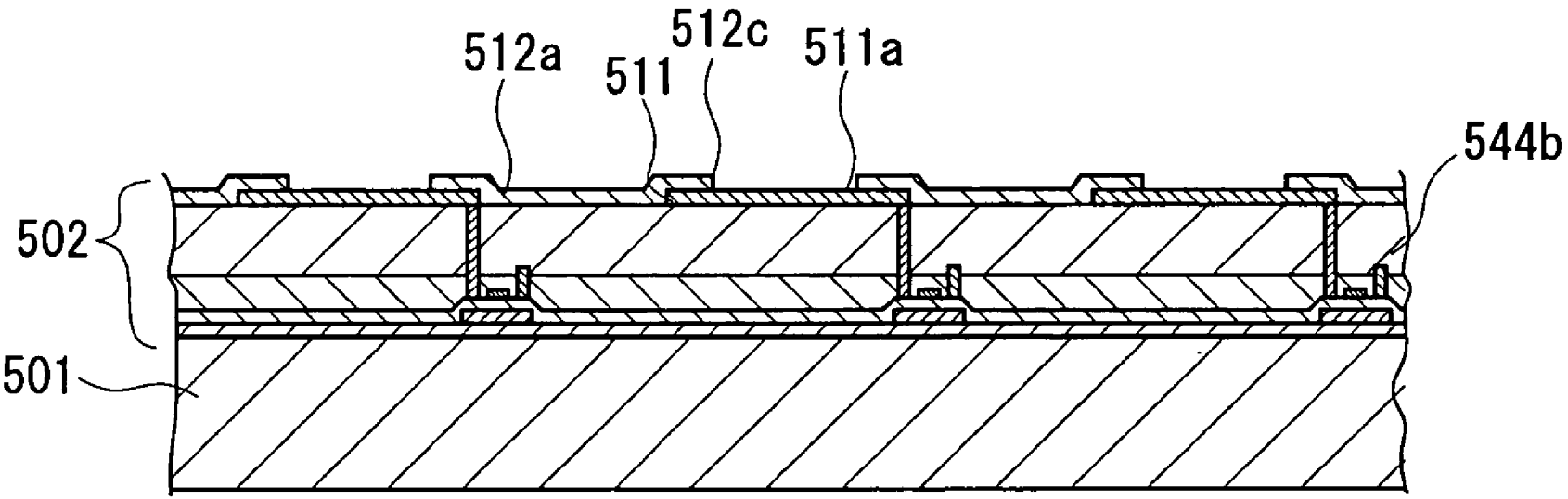
FIG. 11 is a cross-sectional view of a bank part formation step (inorganic bank) in a method of manufacturing an organic EL device according to the embodiment.

First, in the step of forming the inorganic bank layer 512*a*, as shown in FIG. 11, the inorganic bank layer 512*a* is formed on a second interlayer insulating film 544*b* of the circuit element part 502 and on the pixel electrode 511. As the inorganic bank layer 512*a*, an inorganic film of $SiO_2$, $TiO_2$ or the like is formed over the entire surface of the second interlayer insulating film 544*b* and the pixel electrode 511 by means, for example, of a CVD method, a coating method, a sputtering method, a vapor deposition method or the like.

Next, this inorganic film is patterned by etching or the like to provide a lower opening portion 512*c* corresponding to a position where an electrode surface 511*a* of the electrode 511 is formed. At this time, it is required to form the inorganic bank layer 512*a* so as to overlap with a peripheral portion of the electrode 511. As described above, the inorganic bank layer 512*a* is formed in such a manner that the peripheral portion (a part) of the electrode 511 and the inorganic bank layer 512*a* overlap with each other. Thus, a light-emitting region of a luminescent layer 510*b* can be controlled.

Figure 12:
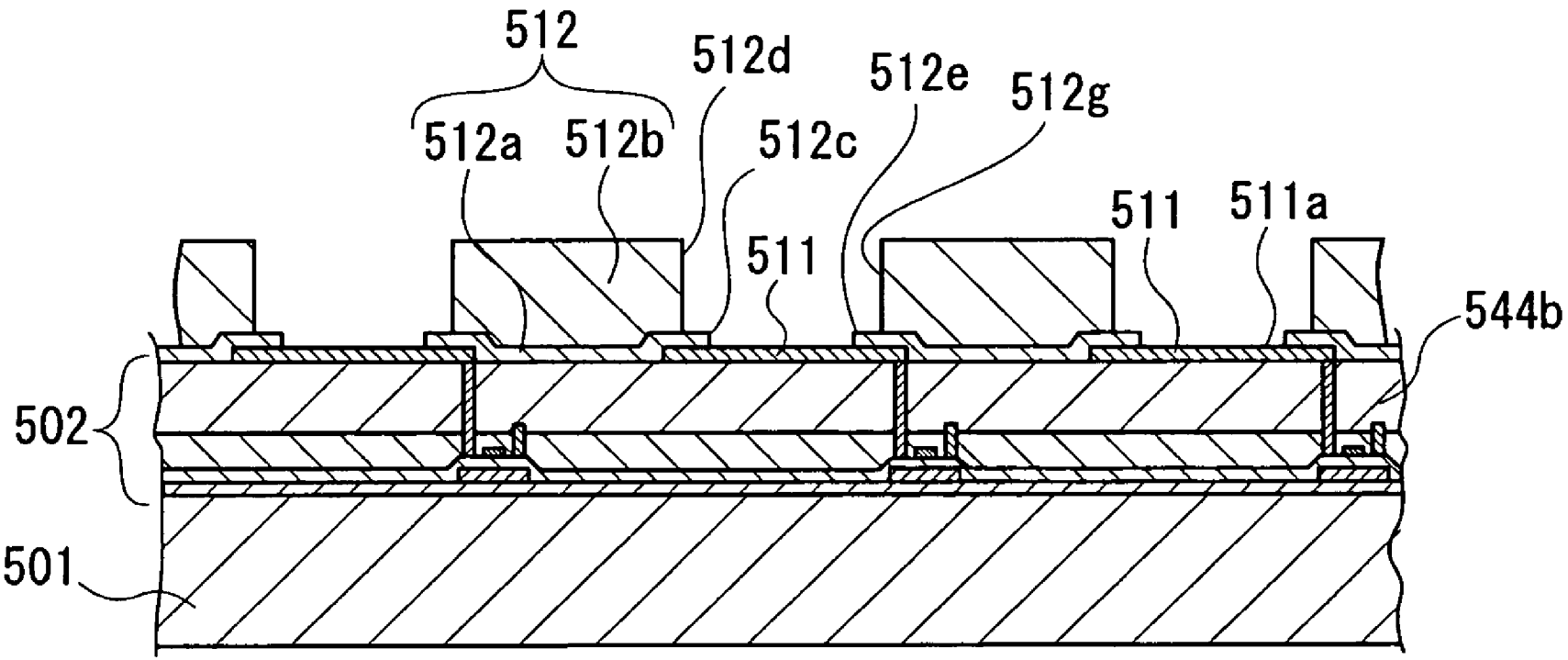
FIG. 12 is a cross-sectional view of the bank part formation step (organic bank) in the method of manufacturing an organic EL device according to the embodiment.

Subsequently, in the step of forming the organic bank layer 512*b*, as shown in FIG. 12, the organic bank layer 512*b* is formed on the organic bank layer 512*a*. The organic bank layer 512*b* is etched by means of a photolithography technology or the like to form an upper opening portion 512*d* of the organic bank layer 512*b*. The upper opening portion 512*d* is provided at a position corresponding to the electrode surface 511*a* and the lower opening portion 512*c*.

As shown in FIG. 12, it is preferable to form the upper opening portion 512*d* wider than the lower opening portion 512*c* and narrower than the electrode surface 511*a*. Accordingly, a first lamination part 512*e* which surrounds the lower opening portion 512*c* of the inorganic bank layer 512*a* protrudes toward a center of the electrode 511 beyond the organic bank layer 512*b*. In this manner, by communicating together the upper opening portion 512*d* and the lower opening portion 512*c*, there is formed the opening portion 512*g* which penetrates the inorganic bank layer 512*a* and the organic bank layer 512*b*.

Next, in the plasma treatment step, a region showing ink affinity and a region showing ink repellency are formed on the surface of the bank part 512 and the pixel electrode surface 511*a*. This plasma treatment step is largely divided into four steps of: a preheating step; a step of imparting ink affinity to an upper surface (512*f*, FIG. 13) of the bank part 512, a wall surface of the opening portion 512*g* and the electrode surface 511*a* of the pixel electrode 511; a step of imparting ink repellency to the upper surface 512*f* of the organic bank layer 512*b* and a wall surface of the upper opening portion 512*d*; and a cooling step.

First, in the preheating step, the substrate 501 including the bank part 512 is heated to a predetermined temperature. Heating is performed, for example, in such a manner that a heater is attached to a stage on which the substrate 501 is mounted and the stage including the substrate 501 is heated by this heater. In concrete, it is preferable that a preheating temperature of the substrate 501 is, for example, in the range of 70 to 80° C.

Figure 13:
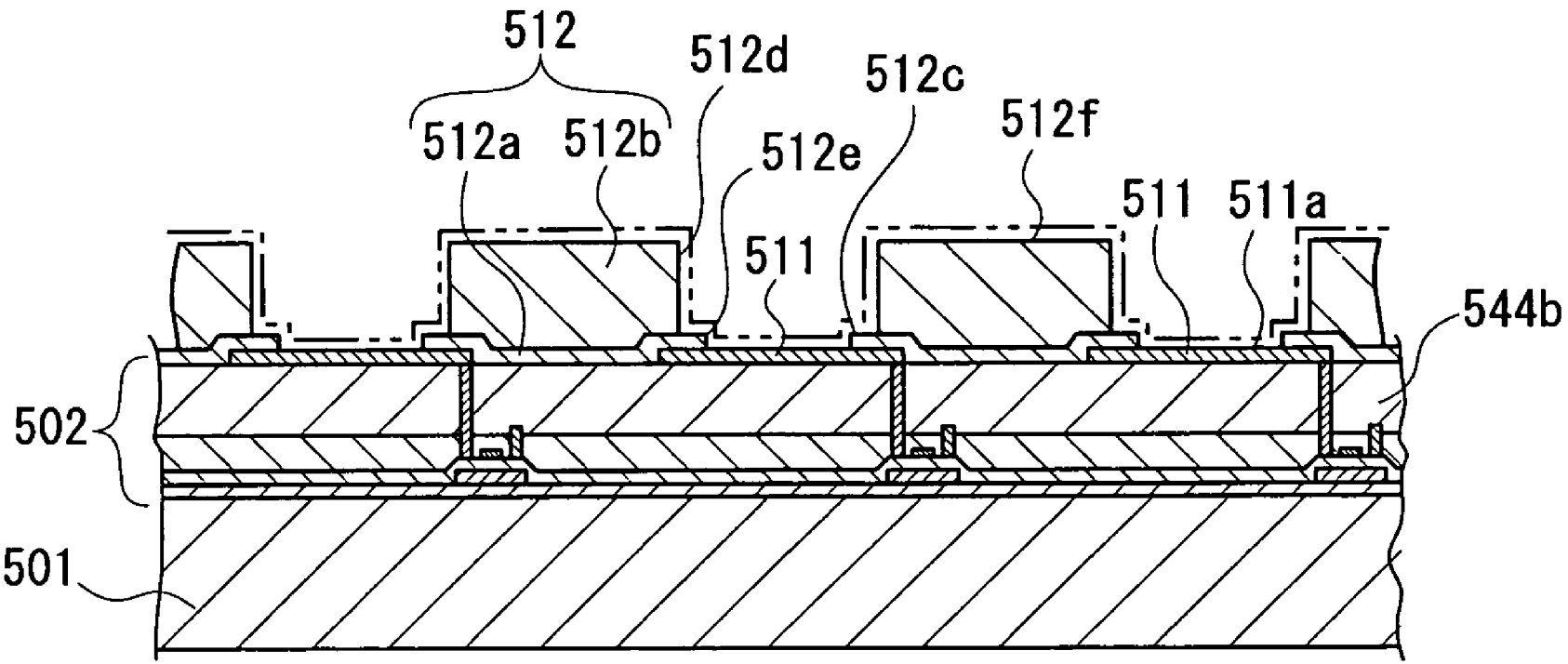
FIG. 13 is a cross-sectional view of a plasma treatment step (ink affinity treatment) in the method of manufacturing an organic EL device according to the embodiment.

Next, in the step of imparting ink affinity, plasma treatment (02 plasma treatment) is performed in the atmosphere by using oxygen as clean gas. By this $O_2$ plasma treatment, as shown in FIG. 13, the electrode surface 511*a* of the pixel electrode 511, the first lamination part 512*e* of the inorganic bank layer 512*a*, the wall surface of the upper opening portion 512*d* of the organic bank layer 512*b* and the upper surface 512*f* of the organic bank layer 512*b* are treated to have ink affinity. By this ink affinity treatment, hydroxyl groups are introduced into the respective surfaces described above and ink affinity is imparted thereto. In FIG. 13, the portion subjected to the ink affinity treatment is indicated by a chain double-dashed line.

Figure 14:
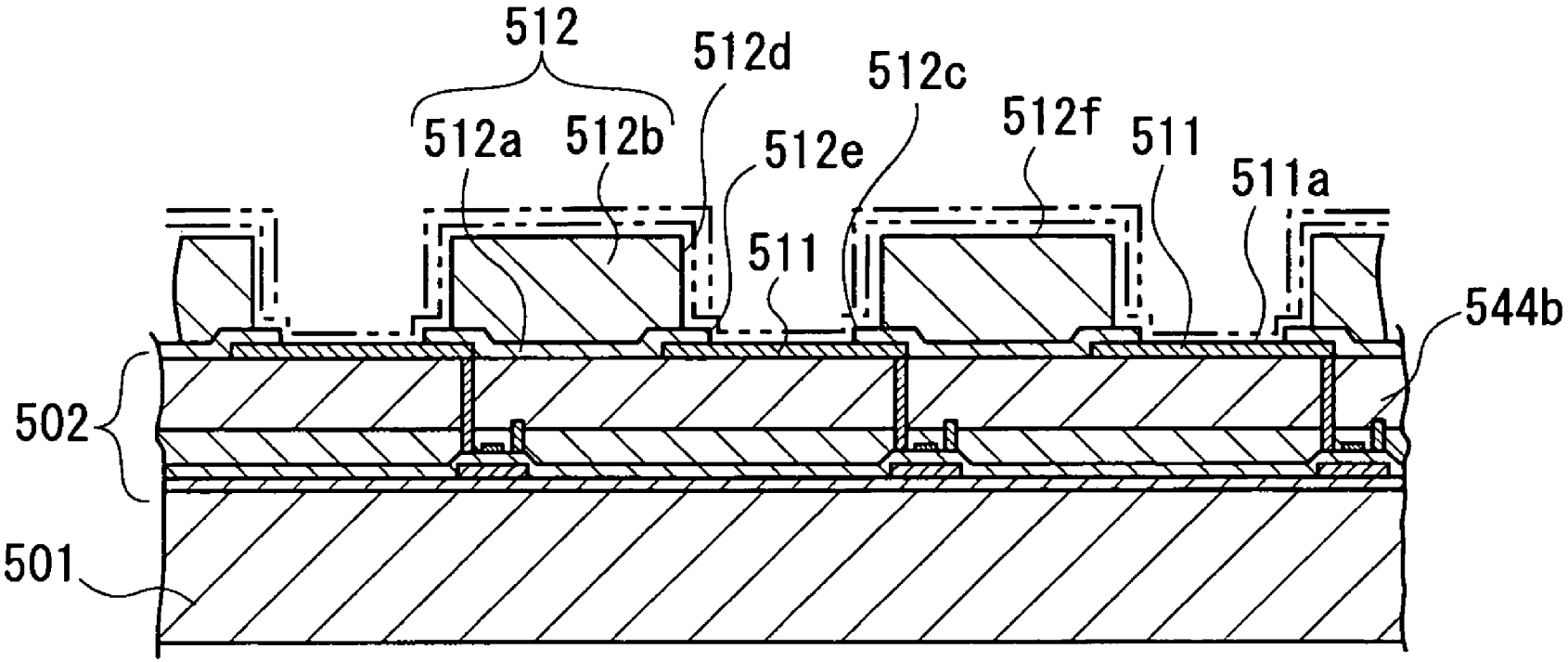
FIG. 14 is a cross-sectional view of the plasma treatment step (ink repellency treatment) in the method of manufacturing an organic EL device according to the embodiment.

Next, in the step of imparting ink repellency, plasma treatment ($CF_4$ plasma treatment) is performed in the atmosphere by using tetrafluoromethane as clean gas (processing gas). By the $CF_4$ plasma treatment, as shown in FIG. 14, the wall surface of the upper opening portion 512*d* and the upper surface 512*f* of the organic bank layer are treated to have ink repellency. By this ink repellency treatment, fluorine groups are introduced into the respective surfaces described above and ink repellency is imparted thereto. In FIG. 14, the region showing ink repellency is indicated by a chain double-dashed line.

Next, in the cooling step, the substrate 501 heated for the plasma treatment is cooled down to room temperature or to a control temperature of an ink jet step (function liquid droplet ejection step). By cooling the substrate 501 after the plasma treatment down to room temperature or to a predetermined temperature (for example, the control temperature for performing the ink jet ejection step), the following hole injection/transport layer formation step can be performed at a fixed temperature.

Next, in the light-emitting element formation step, a light-emitting element is formed by forming a hole injection/transport layer and a luminescent layer on the pixel electrode 511. The light-emitting element formation step is made up of four steps of: a first function liquid droplet ejection step of ejecting a first composition of matter for forming the hole injection/transport layer onto each pixel electrode; a hole injection/transport layer formation step of forming the hole injection/transport layer on the pixel electrode by drying the ejected first composition of matter; a second function liquid droplet ejection step of ejecting a second composition of matter for forming the luminescent layer onto the hole injection/transport layer; and a luminescent layer formation step of forming the luminescent layer on the hole injection/transport layer by drying the ejected second composition of matter.

First, in the first function liquid droplet ejection step, the first composition of matter including a hole injection/transport layer forming material is ejected onto the electrode surface 511*a* by means of an ink jet method (function liquid droplet ejection method). It is preferable that the steps after this first function liquid droplet ejection step are performed in an inert gas atmosphere such as a nitrogen atmosphere without water and oxygen, an argon atmosphere or the like. (In case of forming the hole injection/transport layer only on the pixel electrode, the hole injection/transport layer formed adjacent to the organic bank layer is not formed.)

Figure 15:
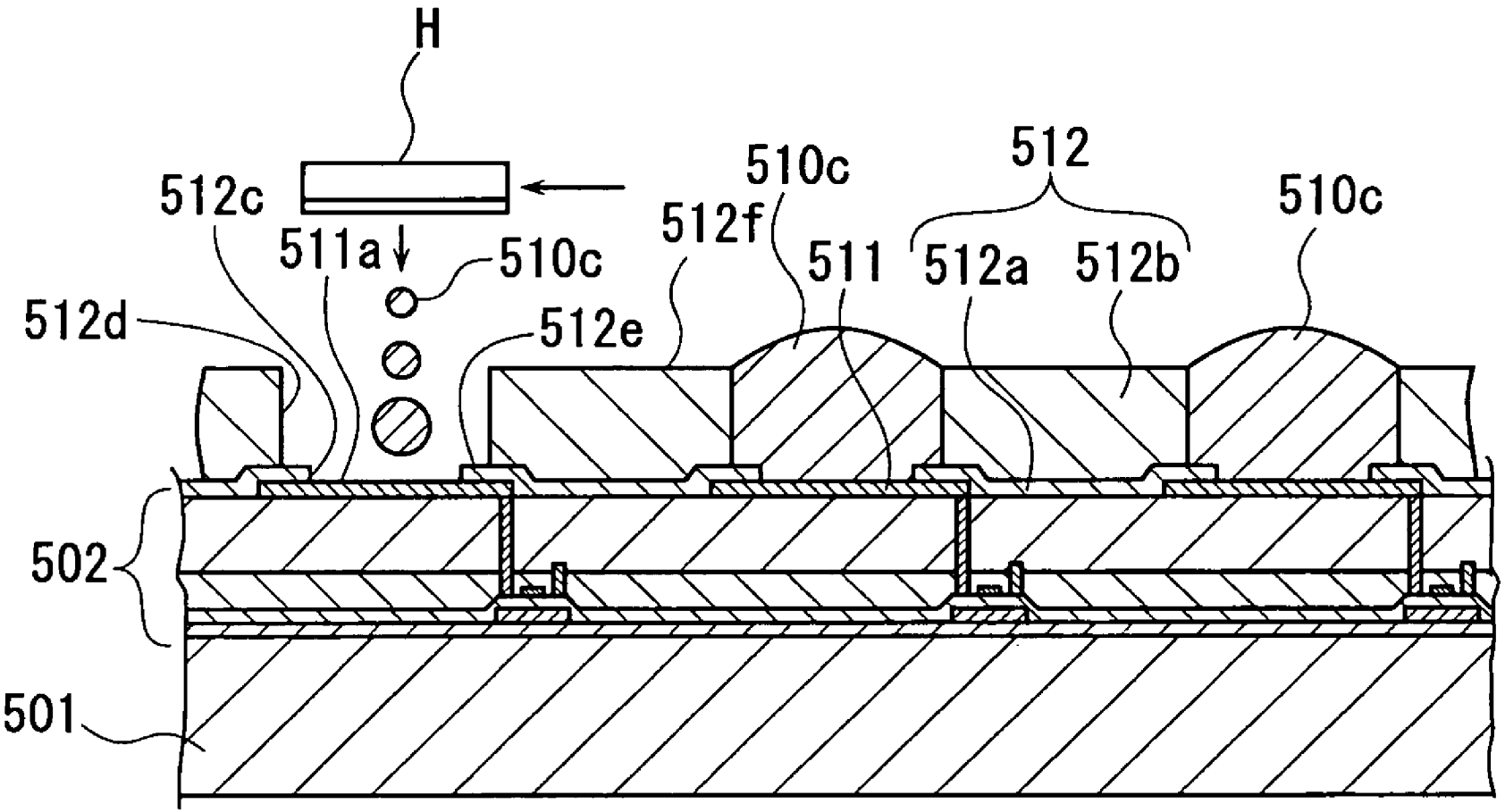
FIG. 15 is a cross-sectional view of a hole injection layer formation step (function liquid droplet ejection) in the method of manufacturing an organic EL device according to the embodiment.

As shown in FIG. 15, an ink jet head (function liquid droplet ejection head 10) H is filled with the first composition of matter including the hole injection/transport layer forming material. Thereafter, ejection nozzles of the ink jet head H are allowed to face the electrode surface 511*a* positioned in the lower opening portion 512*c*. Subsequently, while moving the ink jet head H and the substrate 501 relative to each other, first composition of matter droplets 510*c*, whose amount per droplet is controlled, are ejected onto the electrode surface 511*a* from the ejection nozzles.

As the first composition of matter used here, the following may be used, e.g., a composition of matter prepared by dissolving a mixture of a polythiophene derivative such as polyethylene dioxythiophene (PEDOT), polystyrene sulfonate (PSS) and the like in a polar solvent. As the polar solvent, e.g., isopropyl alcohol (IPA), normal butanol, γ-butyrolactone, N-methylpyrrolidone (NMP), 1,3-dimethyl-2-imidazolidinone (DMI) and derivatives thereof, a glycolether group such as carbitol acetate and butylcarbitol acetate and the like can be enumerated. The same material as the hole injection/transport layer forming material may be used for respective luminescent layers 510*b* of R, G and B, or the material may be changed for each of the luminescent layers.

As shown in FIG. 15, the ejected first composition of matter droplets 510*c* are spread on the electrode surface 511*a* and the first lamination part 512*e*, which have been subjected to the ink affinity treatment, and are filled into the lower and upper opening portions 512*c*, 512*d*. The amount of the first composition of matter ejected onto the electrode surface 511*a* is determined according to sizes of the lower and upper opening portions 512*c*, 512*d*, the thickness of the hole injection/transport layer to be formed, the concentration of the hole injection/transport layer forming material in the first composition of matter and the like. Moreover, the first composition of matter droplets 510*c* may be ejected onto the same electrode surface 511*a* not only once but also several times.

Figure 16:
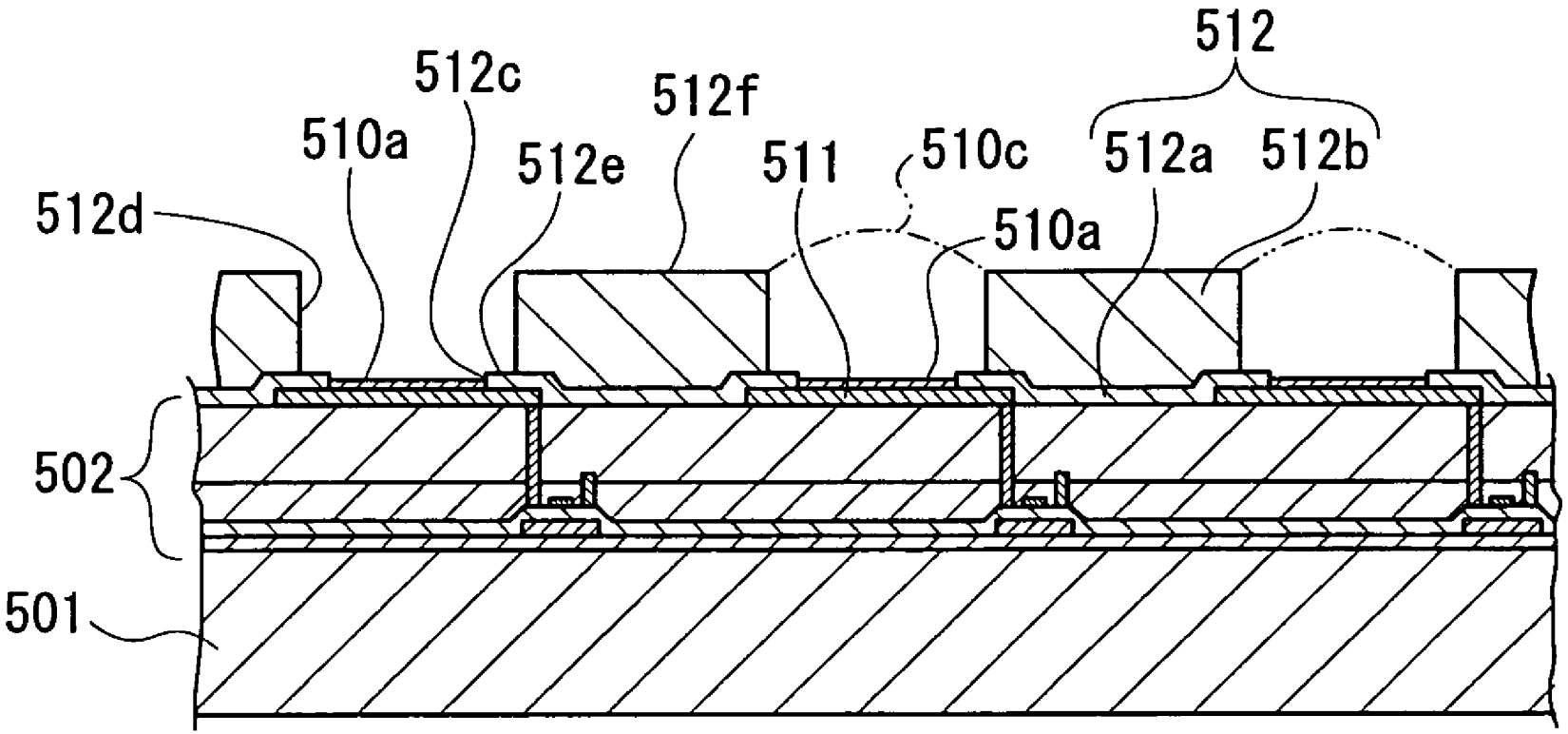
FIG. 16 is a cross-sectional view of the hole injection layer formation step (drying) in the method of manufacturing an organic EL device according to the embodiment.

Next, in the hole injection/transport layer formation step, as shown in FIG. 16, the polar solvent contained in the first composition of matter is evaporated by subjecting the ejected first composition of matter to drying treatment and heat treatment. Thus, a hole injection/transport layer 510*a* is formed on the electrode surface 511*a*. As a result of the drying treatment, evaporation of the polar solvent contained in the first composition of matter droplets 510*c* mainly occurs near the inorganic bank layer 512*a* and the organic bank layer 512*b*. Accordingly, along with the evaporation of the polar solvent, the hole injection/transport layer forming material is concentrated and separated out.

Thus, as shown in FIG. 16, by the drying treatment, evaporation of the polar solvent occurs also on the electrode surface 511*a*. Accordingly, a flat part 510*a* formed of the hole injection/transport layer forming material is formed on the electrode surface 511*a*. On the electrode surface 511*a*, an evaporation rate of the polar solvent is approximately constant. Thus, the hole injection/transport layer forming material is concentrated evenly on the electrode surface 511*a*. Accordingly, the flat part 510*a* having a uniform thickness is formed.

Next, in the second function liquid droplet ejection step, the second composition of matter including a luminescent layer forming material is ejected onto the hole injection/transport layer 510*a* by means of the ink jet method (function liquid droplet ejection method). In this second function liquid droplet ejection step, in order to prevent the hole injection/transport layer 510*a* from being dissolved again, a nonpolar solvent in which the hole injection/transport layer 510*a* is insoluble is used as a solvent of the second composition of matter used in luminescent layer formation.

However, on the other hand, the hole injection/transport layer 510*a* has a low affinity for the nonpolar solvent. Consequently, even if the second composition of matter including the nonpolar solvent is ejected onto the hole injection/transport layer 510*a*, there is a possibility that the hole injection/transport layer 510*a* and the luminescent layer 510*b* cannot adhere to each other or the luminescent layer 510*b* cannot be applied evenly. Accordingly, in order to improve the affinity of the surface of the hole injection/transport layer 510*a* for the nonpolar solvent and the luminescent layer forming material, it is preferable that a surface modification step is performed before formation of the luminescent layer.

Therefore, the surface modification step will be described first. The surface modification step is performed in the following manner. Namely, a surface modification solvent that is the same solvent as, or the similar solvent to, the nonpolar solvent of the second composition of matter used in luminescent layer formation is applied onto the hole injection/transport layer 510*a* by means of the ink jet method (function liquid droplet ejection method), a spin coat method or a dip method. Thereafter, the surface modification solvent is dried.

Figure 17:
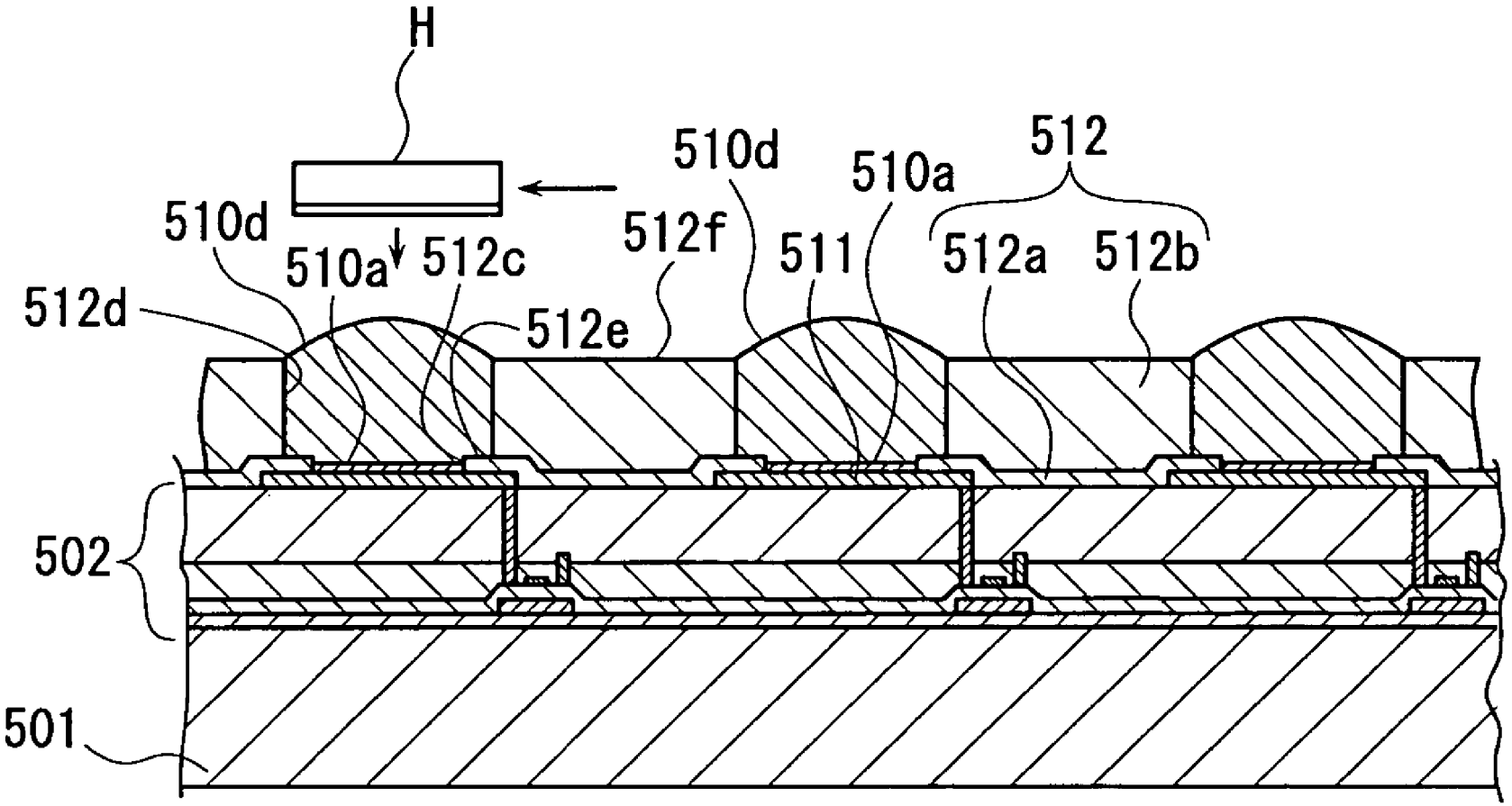
FIG. 17 is a cross-sectional view of a surface modification step (function liquid droplet ejection) in the method of manufacturing an organic EL device according to the embodiment.
Figure 18:
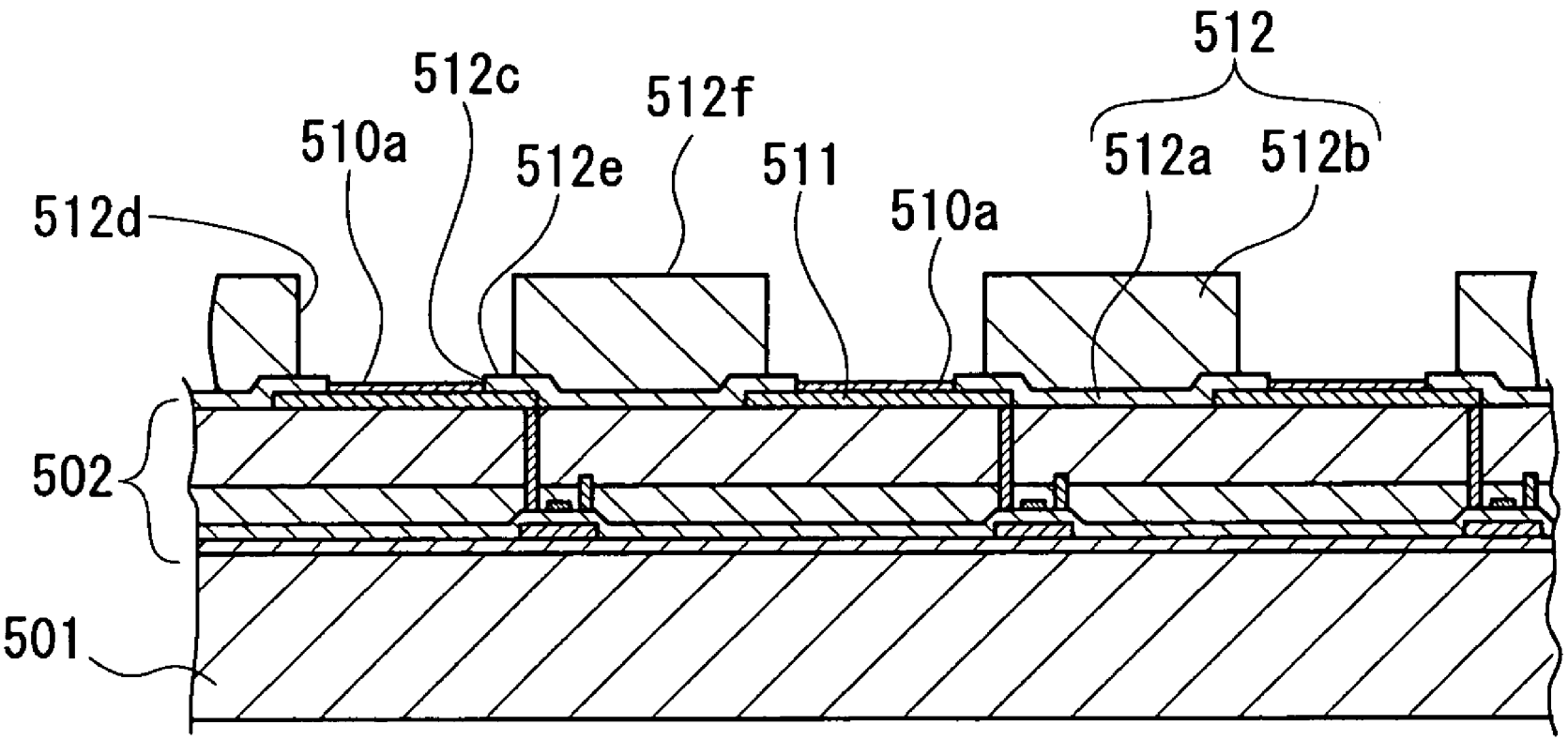
FIG. 18 is a cross-sectional view of the surface modification step (drying) in the method of manufacturing an organic EL device according to the embodiment.

For example, as shown in FIG. 17, application by means of the ink jet method is performed in the following manner. Namely, the ink jet head H is filled with the surface modification solvent and the ejection nozzles of the ink jet head H are allowed to face the substrate (that is, the substrate having the hole injection/transport layer 510*a* formed thereon). Thereafter, while moving the ink jet head H and the substrate 501 relatively to each other, the surface modification solvent 510*d* is ejected onto the hole injection/transport layer 510*a* from the ejection nozzles. Subsequently, as shown in FIG. 18, the surface modification solvent 510*d* is dried.

Figure 19:
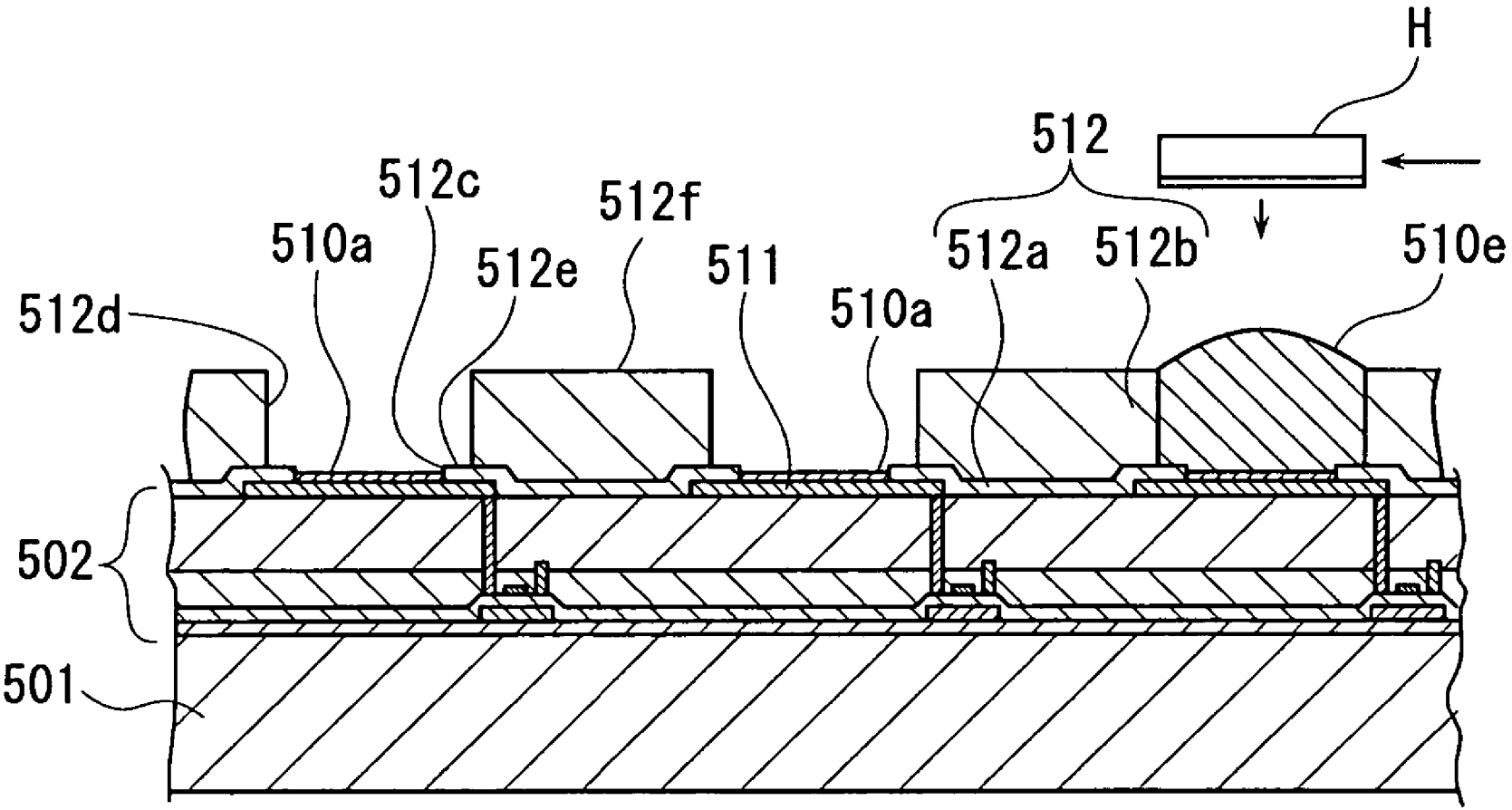
FIG. 19 is a cross-sectional view of a B luminescent layer formation step (function liquid droplet ejection) in the method of manufacturing an organic EL device according to the embodiment.

Next, in the second function liquid droplet ejection step, the second composition of matter including the luminescent layer forming material is ejected onto the hole injection/transport layer 510*a* by means of the ink jet method (function liquid droplet ejection method). As shown in FIG. 19, the ink jet head H is filled with the second composition of matter including a blue (B) luminescent layer forming material, and the ejection nozzles of the ink jet head H are allowed to face the hole injection/transport layer 510*a* positioned in the lower and upper opening portions 512*c*, 512*d*. Thereafter, while moving the ink jet head H and the substrate 501 relative to each other, the second composition of matter is ejected as second composition of matter droplets 510*e*, whose amount per droplet is controlled, from the ejection nozzles. Accordingly, the second composition of matter droplets 510*e* are ejected onto the hole injection/transport layer 510*a*.

As the luminescent layer forming material, a polyfluorene polymer derivative, a (poly) para-phenylene vinylene derivative, a polyphenylene derivative, polyvinylcarbazole, a polythiophene derivative, a perylene dye, a coumarin dye, a rhodamine dye or one obtained by doping the above-described polymers with an organic EL material can be used. For example, there can be used one doped with rubrene, perylene, 9,10-diphenylanthracene, tetraphenylbutadiene, Nile red, coumarin 6, quinacridone and the like.

As the nonpolar solvent, it is preferable to use one which does not dissolve the hole injection/transport layer 510*a*. For example, cyclohexylbenzene, dihydrobenzofuran, trimethylbenzene, tetramethylbenzene and the like can be used. By using such a nonpolar solvent as the second composition of matter of the luminescent layer 510*b*, the second composition of matter can be applied without dissolving the hole injection/transport layer 510*a* again.

As shown in FIG. 19, the ejected second composition of matter 510*e* is spread on the hole injection/transport layer 510*a* and is filled into the lower and upper opening portions 512*c*, 512*d*. The second composition of matter 510*e* may be ejected onto the same hole injection/transport layer 510*a* not only once but also several times. In this case, the amount of the second composition of matter in each time of ejections may be the same or may be changed each time.

Figure 20:
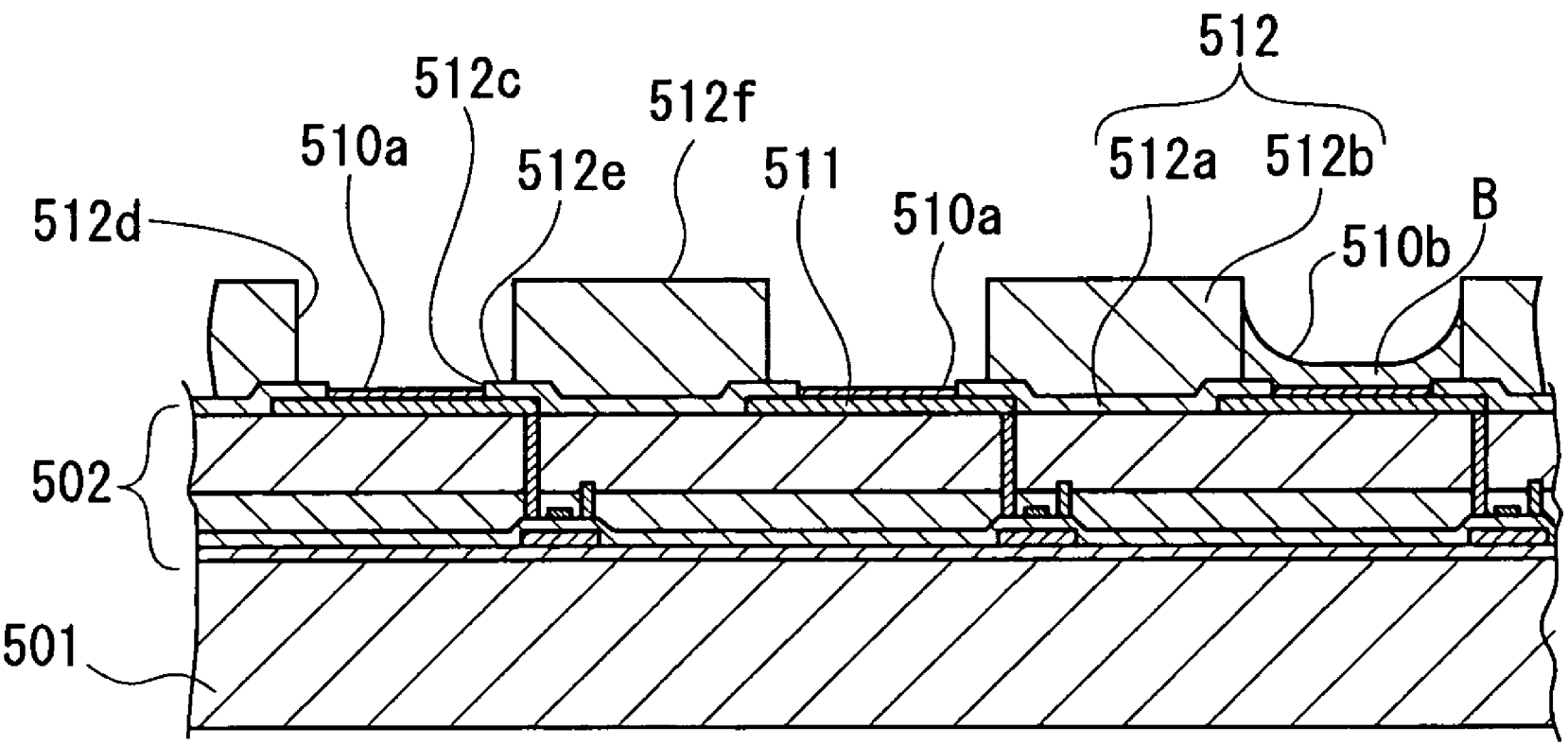
FIG. 20 is a cross-sectional view of the B luminescent layer formation step (drying) in the method of manufacturing an organic EL device according to the embodiment.

Next, in the luminescent layer formation step, after the second composition of matter is ejected, drying treatment and heat treatment are performed. Thus, the luminescent layer 510*b* is formed on the hole injection/transport layer 510*a*. By subjecting the ejected second composition of matter to the drying treatment, the nonpolar solvent contained in the second composition of matter is evaporated. Accordingly, a blue (B) luminescent layer 510*b* as shown in FIG. 20 is formed.

Figure 21:
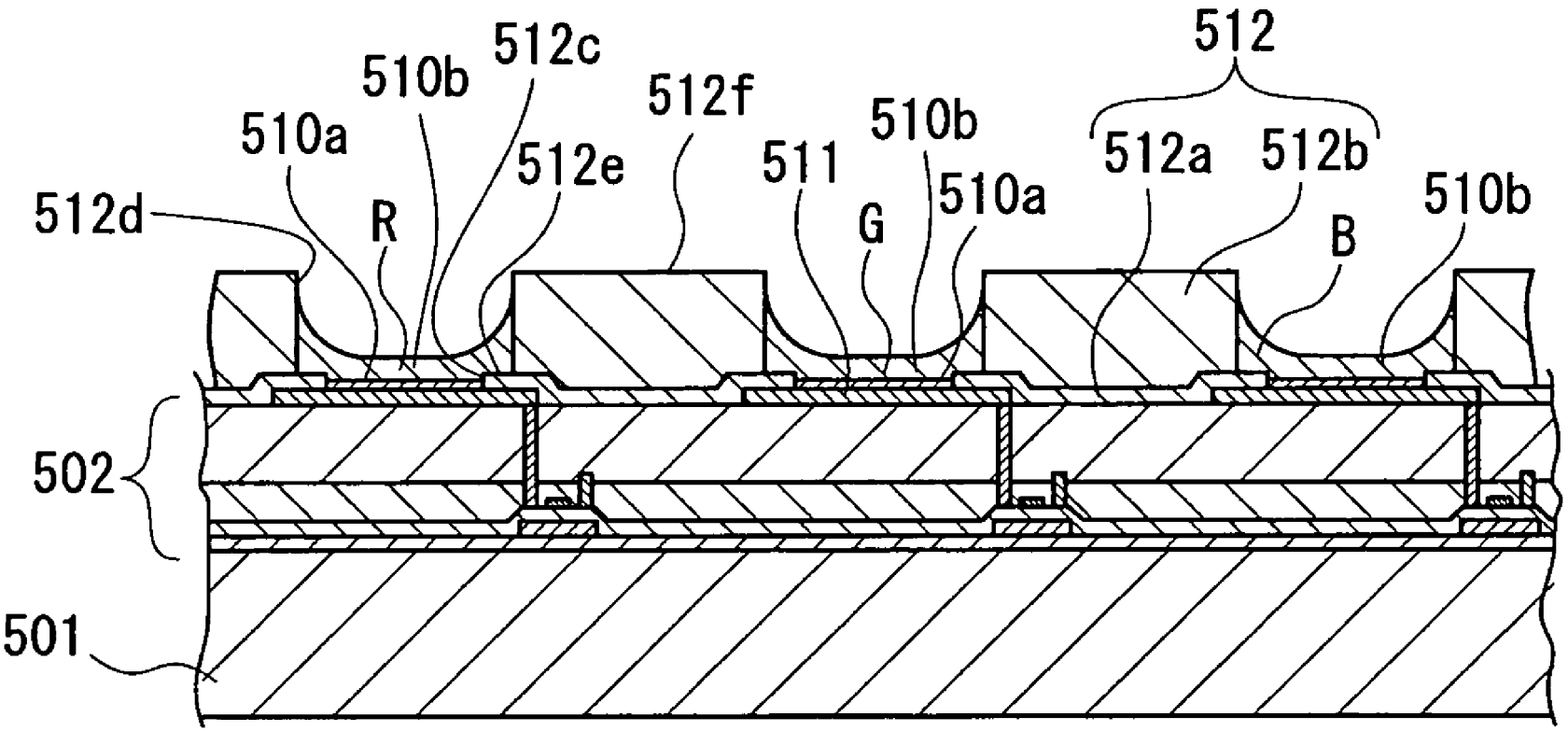
FIG. 21 is a cross-sectional view of an R, G and B luminescent layer formation step in the method of manufacturing an organic EL device according to the embodiment.

Subsequently, as shown in FIG. 21, similar to the case of the blue (B) luminescent layer 510*b*, a red (R) luminescent layer 510*b* is formed, and a green (G) luminescent layer 510*b* is formed last of all. The order of forming the luminescent layers 510*b* is not limited to the one described above. The luminescent layers may be formed in any order. For example, the order of formation can be determined in accordance with the luminescent layer forming material.

Figure 22:
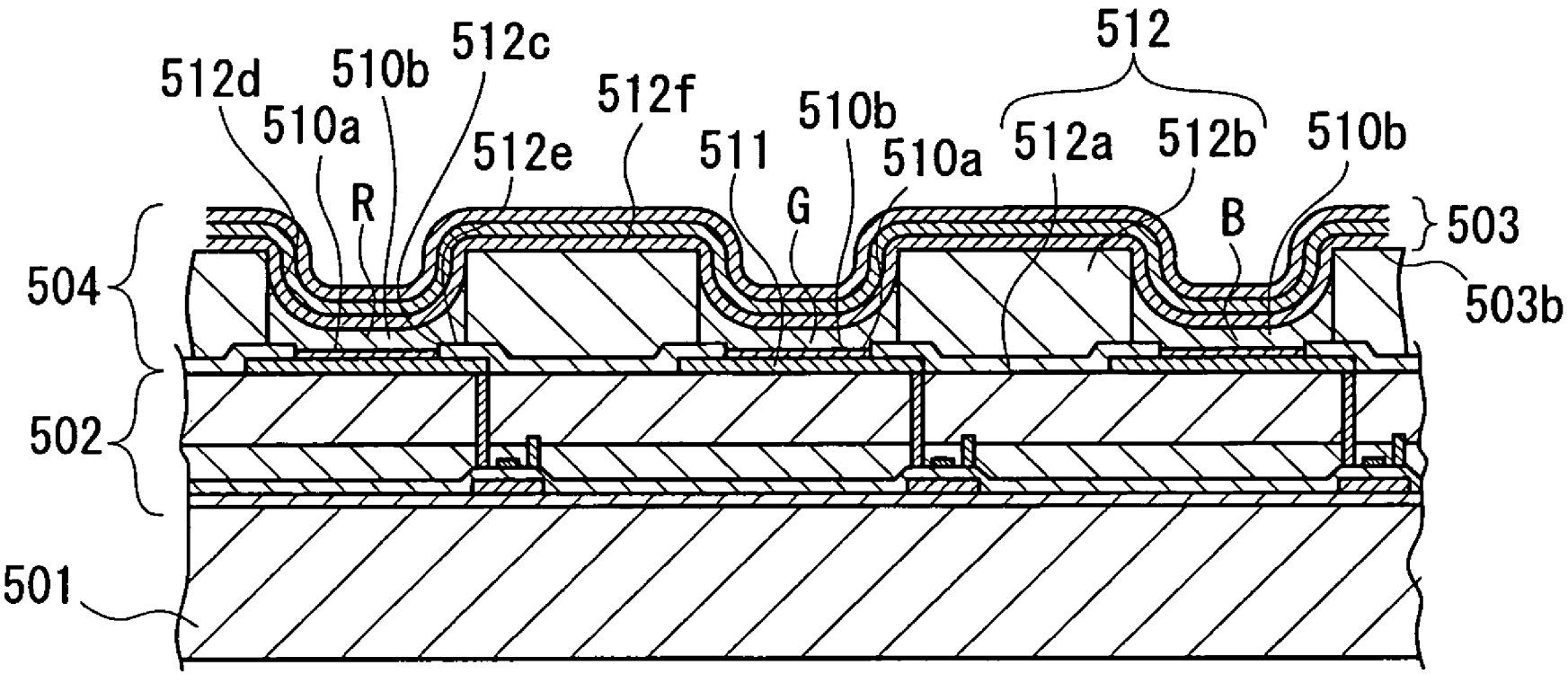
FIG. 22 is a cross-sectional view of a counter electrode formation step in the method of manufacturing an organic EL device according to the embodiment.

Next, in the counter electrode formation step, as shown in FIG. 22, a cathode (counter electrode) 503 is formed over the luminescent layers 510*b* and the organic bank layers 512*b*. The cathode 503 may be formed by laminating a plurality of materials. For example, it is preferable that a material having a small work function is formed near the luminescent layers. As such a material, e.g., Ca, Ba and the like can be used. Moreover, depending on materials, it is preferable, in some cases, to thinly form a lower layer of LiF or the like. Moreover, it is preferable that an upper part (sealing side) of the cathode is formed of a material having a higher work function than that of a lower part thereof. It is preferable that the cathode (cathode layer) 503 described above is formed by means, for example, of the vapor deposition method, the sputtering method, the CVD method or the like. Particularly, it is preferable to form the cathode by means of the vapor deposition method in that the luminescent layers 510*b* can be prevented from being damaged by heat.

Moreover, lithium fluoride may be formed only on the luminescent layers 510*b* or may otherwise be formed only on the blue (B) luminescent layer 510*b*. In this case, an upper cathode layer 503*b* which is formed of LiF comes into contact with the other red (R) and green (G) luminescent layers 510*b*, 510*b*. Moreover, as the upper part of the cathode 503, it is preferable to use an Al film, an Ag film and the like, which are formed by means of the vapor deposition method, the sputtering method, the CVD method or the like. Moreover, on the cathode 503, a protective layer such as $SiO_2$ and SiN may be provided to prevent oxidation.

Figure 23:
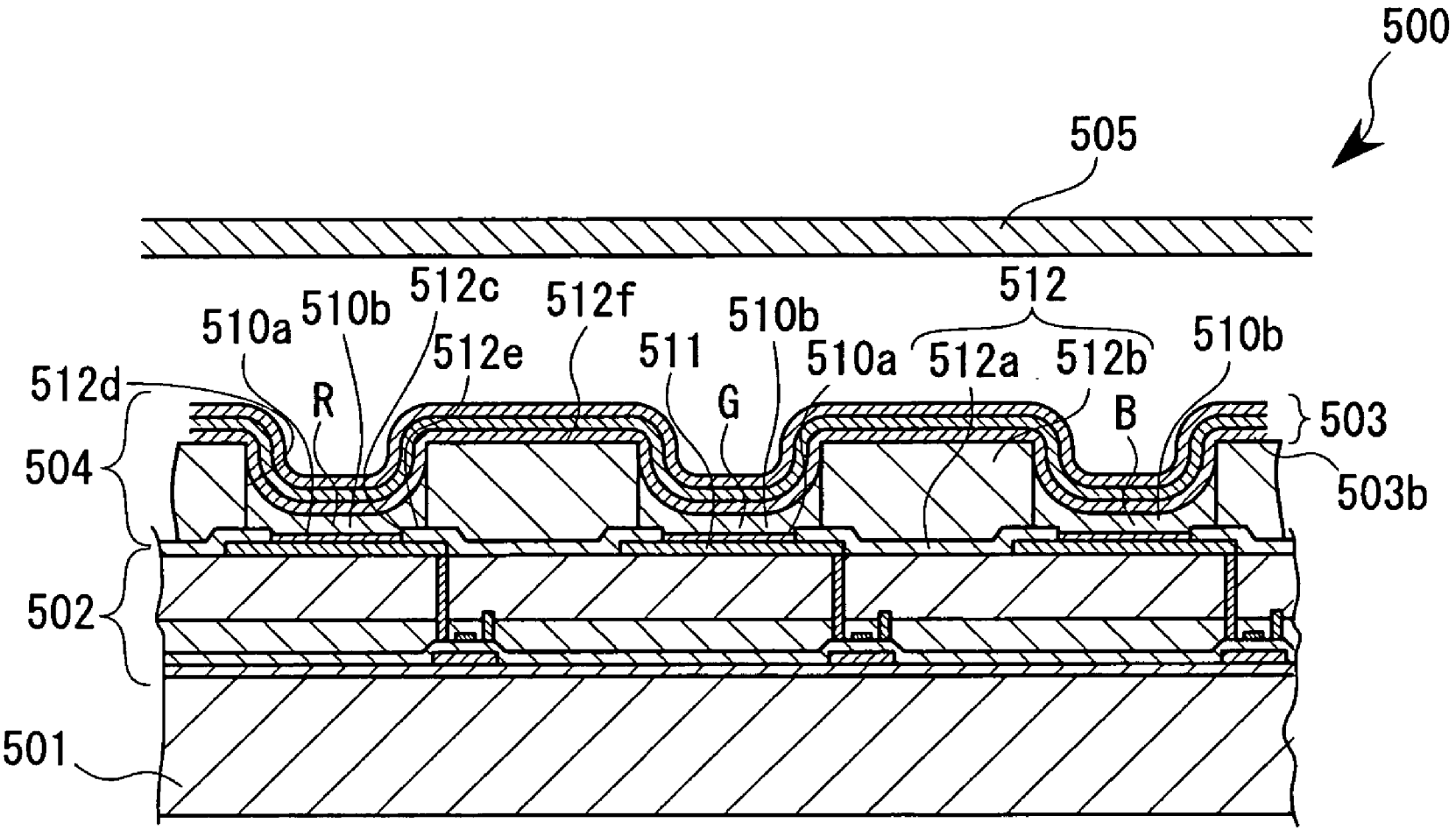
FIG. 23 is a cross-sectional view of a sealing step in the method of manufacturing an organic EL device according to the embodiment.

Finally, in the sealing step shown in FIG. 23, in an inert gas atmosphere such as nitrogen, argon and helium, a sealing substrate 505 is laminated on an organic EL element 504. It is preferable to perform the sealing step in the inert gas atmosphere such as nitrogen, argon and helium. It is not preferable to perform the sealing step in atmosphere because, if there is a flaw such as a pin hole in the cathode 503, there is a possibility that water, oxygen and the like enter the cathode 503 through a portion of this flaw to thereby oxidize the cathode 503. Last of all, wiring of a flexible substrate is connected to the cathode 503, and also wiring of the circuit element part 502 is connected to a drive IC. Thus, an organic EL device 500 of this embodiment is obtained.

In formation of the pixel electrode 511 and the cathode (counter electrode) 503, the ink jet method by means of the ink jet head H may be adopted. In other words, a liquid electrode material is introduced into the ink jet head H and is ejected from the ink jet head H. Thus, the pixel electrode 511 and the cathode 503 are formed, respectively (including the drying step).

Similarly, the function liquid droplet ejection apparatus 1 of this embodiment can be applied to a method of manufacturing an electron emission device, a method of manufacturing a PDP device, a method of manufacturing an electrophoretic display device, or the like.

In the method of manufacturing an electron emission device, fluorescent materials of respective colors R, G and B are introduced into the function liquid droplet ejection head 10, and the function liquid droplet ejection head 10 is subjected to main scanning and sub-scanning to thereby selectively eject the fluorescent materials. As a result, a multiplicity of phosphors are formed on electrodes. The electron emission device is a generic concept including a field emission display (FED).

In the method of manufacturing a PDP device, fluorescent materials of the respective colors R, G and B are introduced into the function liquid droplet ejection head 10, and the function liquid droplet ejection head 10 is subjected to main scanning and sub-scanning to thereby selectively eject the fluorescent materials. As a result, fluorescent members are formed in a multiplicity of respective concave portions on the rear substrate.

In the method of manufacturing an electrophoretic display device, migrating body materials of respective colors are introduced into the function liquid droplet ejection head 10, and the function liquid droplet ejection head 10 is subjected to main scanning and sub-scanning to thereby selectively eject the ink materials. As a result, migrating bodies are formed in a multiplicity of concave portions on electrodes, respectively. It is preferable that a migrating body made of a charged particle and a dye is sealed in a microcapsule.

The function liquid droplet ejection apparatus 1 of this embodiment can also be applied to a method of forming a spacer, a method of forming a metallic wiring, a method of forming a lens, a method of forming a resist, a method of forming a light diffusion body or the like.

In the method of forming a spacer, a multiplicity of particulate spacers are formed to form a minute cell gap between two substrates. A particle material for forming the spacer is introduced into the function liquid droplet ejection head 10, and the function liquid droplet ejection head 10 is subjected to main scanning and sub-scanning to selectively eject the particle material. The spacer is thus formed on at least one of the substrates. The method of forming a spacer is useful, for example, in the case of forming a cell gap between two substrates in the above-described liquid crystal display device and electrophoretic display device. Aside from the above, it is needless to say that the method of forming a spacer can be applied to a semiconductor manufacturing technology which requires this kind of minute gap.

In the method of forming a metallic wiring, a liquid metal material is introduced into the function liquid droplet ejection head 10, and the function liquid droplet ejection head 10 is subjected to main scanning and sub-scanning to selectively eject the liquid metal material. A metallic wiring is thus formed on a substrate. This method can be applied to the metallic wiring which connects a driver and each electrode in the above-described liquid crystal display device and to the metallic wiring which connects a TFT and the like and each electrode in the above-described organic EL device. Moreover, besides this kind of flat display, it is needless to say that the method of manufacturing a metallic wiring can be applied to general semiconductor manufacturing technologies.

In the method of forming a lens, a lens material is introduced into the function liquid droplet ejection head 10, and the function liquid droplet ejection head 10 is subjected to main scanning and sub-scanning to selectively eject the lens material. A multiplicity of microlenses are thus formed on a transparent substrate. The microlens can be applied, e.g., to a device for converging beams in the above-described FED device. Moreover, it is needless to say that the microlens can be applied to various optical devices.

In the method of forming a resist, a resist material is introduced into the function liquid droplet ejection head 10, and the function liquid droplet ejection head 10 is subjected to main scanning and sub-scanning to selectively eject the resist material. A photoresist having an arbitrary shape is thus formed on a substrate. The method of forming a resist can be widely applied, e.g., to formation of banks in the above-described various display devices as well as to application of a photoresist in a photolithography method which constitutes the main part of the semiconductor manufacturing technology.

The method of forming a light diffusion body is a method of forming a large number of light diffusion bodies on a substrate, in which a light diffusion material is introduced into the function liquid droplet ejection head 10, and the function liquid droplet ejection head 10 is subjected to main scanning and sub-scanning to selectively eject the light diffusion material. A multiplicity of light diffusion bodies are thus formed. In this case, it is needless to say that the method of forming a light diffusion body can also be applied to various optical devices.

As described above, in the method of controlling drive of a function liquid droplet ejection head and the function liquid droplet ejection apparatus 1 according to this invention, the function liquid droplet ejection head 10 is used, in which a plurality of nozzle arrays having different function liquid droplet ejection amounts from each other per unit nozzle are arranged. The function liquid droplets can therefore be efficiently ejected within one pixel. In addition, a uniform film thickness can be obtained. Moreover, drive of the plurality of nozzle arrays arranged in the function liquid droplet ejection head 10 is controlled by using a single drive signal (COM). Thus, it is not required to generate drive signals corresponding to the number of nozzle arrays. Namely, one function liquid droplet ejection head 10 is controlled by using a single drive signal. Thus, drive control can be easily performed. Furthermore, the drive signal for controlling the function liquid droplet ejection head 10 has a plurality of ejection pulses corresponding to the plurality of nozzle arrays in one print cycle. Accordingly, it is not required for the drive signal generation unit (drive signal generation part) to perform switching of the drive signal applied to each nozzle array. Thus, the high-frequency drive can be attained; in other words, an improvement in the printing throughput can be achieved.

Further, the respective nozzle arrays are driven by using the ejection pulses having waveforms which are different from each other in accordance with the specifications of the corresponding nozzle arrays. Therefore, nozzles having various specifications (the nozzle orifice diameter, the shape of the nozzle orifice and the like) can be used, and function liquids of various weights or viscosities can be ejected.

Still furthermore, since the flushing that is the function recovery processing does not require fine adjustment of the amount of function liquid droplets to be ejected or high ejection accuracy, the drive of the plurality of nozzle arrays can be easily controlled by using the same ejection pulse. As a result, since the print cycle is shortened, in the case of performing the flushing, high-frequency drive is possible.

Moreover, the function liquid which forms the meniscus is subjected to micro oscillation by using the micro oscillation pulse included in the drive signal. Thus, it is possible to prevent the function liquid in the vicinity of the nozzle orifice portion from increasing in viscosity, whereby a good ejection state of the function liquid can be maintained. Moreover, only one waveform of the micro oscillation pulse is inputted regardless of the number of ejection pulses to be inputted later. Thus, influences on the printing throughput can be reduced. Furthermore, since the micro oscillation pulse is inputted before the ejection pulses, also at the time of input of the first ejection pulse, a normal function liquid which is free from thickening can be ejected.

Further, the drive signal has the damping pulse for damping the residual oscillation of the pressure generating element 65. Thus, stable ejection of the function liquid can be performed all the time without imposing influences of the last inputted ejection pulse on the next drive pulse. Furthermore, since the damping pulse has the waveform corresponding to the waveform of the last inputted ejection pulse, the damping pulse can damp the residual oscillation more surely.

Moreover, the function liquid droplet ejection head 10 is made up of the two nozzle arrays 10*a*, 10*b* having function liquid droplet ejection amounts which are different from each other per unit nozzle. Thus, by using the drive signal having two ejection pulses (the second and third pulses), the function liquid droplets can be easily and efficiently ejected within one pixel 40 (see FIG. 3). Moreover, the number of nozzles of the second nozzle array (small nozzle array) 10*b* is two times as many as the number of nozzles of the first nozzle array (large nozzle array) 10*a*. Thus, each of the pixels 40 can be filled without leaving any space therein. Consequently, a more uniform film thickness can be obtained.

On the other hand, the electro-optical device of this invention is manufactured by using the above-described function liquid droplet ejection head 10 made up of a plurality of nozzle arrays having function liquid droplet ejection amounts which are different from each other per unit nozzle. Thus, an even film thickness can be obtained within each of the pixels 40.

Moreover, the function liquid droplet ejection head 10 made up of a plurality of nozzle arrays having function liquid droplet ejection amounts which are different from each other per unit nozzle is used in the method of manufacturing a liquid crystal display device, the method of manufacturing an organic EL device, the method of manufacturing an electron emission device, the method of manufacturing a PDP device, the method of manufacturing an electrophoretic display device, the method of manufacturing a color filter, the method of manufacturing an organic EL, the method of forming a spacer, the method of forming a metallic wiring, the method of forming a lens, the method of forming a resist and the method of forming a light diffusion body according to this invention. Thus, a good electro-optical device can be manufactured.

In the above-described example, the same kind of function liquid is ejected from the large and small nozzles 11*a*, 11*b*. However, function liquids of different kinds or colors may be ejected from the nozzles. According to this arrangement, function liquids of different weights and viscosities can be ejected by one function liquid droplet ejection head 10. Thus, the applicable specifications can be expanded such as that the electro-optical device as described above is manufactured by using one function liquid droplet ejection head 10.

Moreover, in the above-described example, the function liquid droplet ejection head 10, in which one array of the large nozzles 11*a* and one array of the small nozzles 11*b* are disposed, is described as an example. However, the function liquid droplet ejection head 10 can also have a form in which a plurality of, e.g., three or four, nozzle arrays having function liquid droplet ejection amounts which are different from each other per unit nozzle. Moreover, in this case, it is also possible to use a micro oscillation pulse which is common to all, as countermeasures against thickening. Furthermore, also in the flushing, it is possible to use the common ejection pulse. However, as to the damping pulse for damping the residual oscillation, it is preferable to input the damping pulse according to the waveform and maximum potential of the ejection pulse included in the drive signal.

As described above, by using the method of controlling drive of a function liquid droplet ejection head and the function liquid droplet ejection apparatus according to this invention, even if a plurality of nozzle arrays having function liquid droplet ejection amounts which are different from each other per unit nozzle are arranged in one function liquid droplet ejection head, easy drive control is possible without lowering the printing throughput.

Moreover, in the electro-optical device and in the method of manufacturing a liquid crystal display device, the method of manufacturing an organic EL device, the method of manufacturing an electron emission device, the method of manufacturing a PDP device, the method of manufacturing an electrophoretic display device, the method of manufacturing a color filter, the method of manufacturing an organic EL, the method of forming a spacer, the method of forming a metallic wiring, the method of forming a lens, the method of forming a resist and the method of forming a light diffusion body according to this invention, there is used the above-described function liquid droplet ejection head including a plurality of nozzle arrays having different function liquid droplet ejection amounts which are different from each other per unit nozzle. Thus, there is an effect in that a good electro-optical device can be manufactured quickly and easily.

What is claimed is:

1. A function liquid droplet ejection apparatus which selectively ejects function liquid droplets while performing a relative movement between a workpiece and a function liquid droplet ejection head into which a function liquid is introduced, the apparatus comprising:

the function liquid droplet ejection head having disposed therein a plurality of nozzle arrays with a different function liquid droplet ejection amount per unit nozzle; and control means for controlling drive of the plurality of nozzle arrays by using a single drive signal, the drive signal having, in one print cycle, waveforms which are inputted in a manner different from one another in accordance with specifications of each of the nozzle arrays, wherein all the nozzles of the nozzle array use the same waveform, and a waveform which is inputted in a manner common to each of the nozzle arrays.

2. The apparatus according to claim 1, wherein the control means controls the plurality of nozzle arrays by using the waveform which is inputted in a manner common to each of the nozzle arrays in a case of performing flushing which is function recovery process by waste discharging of liquid droplets from all nozzles.

3. A method of ejecting function liquid from a plurality of nozzle arrays with a different function liquid droplet ejection amount per unit nozzle, the method comprising:

controlling the plurality of nozzle arrays with a single drive signal, the drive signal having, in one print cycle, waveforms which are inputted in a manner different from one another in accordance with specifications of each of the nozzle arrays, wherein all the nozzles of the nozzle array use the same waveform, and a waveform which is inputted in a manner common to each of the nozzle arrays.

4. A method of manufacturing a liquid crystal display device, in which a multiplicity of filter elements are formed on a color filter substrate by using the method of ejecting function liquid according to claim 3, wherein the function liquid is a filter material, the method comprising performing a relative scanning between the plurality of nozzle arrays and the substrate to thereby selectively eject the filter material, whereby the multiplicity of the filter elements are formed.

5. A method of manufacturing an organic EL device, in which an EL layer is formed in each of a multiplicity of picture element pixels on a substrate by using the method of ejecting function liquid according to claim 3, wherein the function liquid is a luminescent material, the method comprising performing a relative scanning between the plurality of nozzle arrays and the substrate to thereby selectively eject the luminescent material, whereby the EL layer is formed.

6. A method of manufacturing an electron emission device, in which phosphor is formed on electrodes by using the method of ejecting function liquid according to claim 3, wherein the function liquid is phosphor, the method comprising performing a relative scanning between the plurality of nozzle arrays and the electrode to thereby selectively eject the phosphor, whereby the phosphor is formed.

7. A method of manufacturing a PDP device, in which phosphor is formed in each of a multiplicity of concave portions on a rear substrate by using the method of ejecting function liquid according to claim 3, wherein the function liquid is phosphor, the method comprising performing a relative scanning between the plurality of nozzle arrays and the rear substrate to thereby selectively eject the phosphor, whereby the phosphor is formed.

8. A method of manufacturing an electrophoretic device, in which migrating body is formed in each of a multiplicity of concave portions on electrodes by using the method of ejecting function liquid according to claim 3, wherein the function liquid is a migrating body, the method comprising performing a relative scanning between the plurality of nozzle arrays and the electrodes to thereby selectively eject the migrating body, whereby the electrophoretic device is formed.

9. A method of manufacturing a color filter, in which a color filter having disposed therein a multiplicity of filter elements is manufactured by using the method of ejecting function liquid according to claim 3, wherein the function liquid is a filter material, the method comprising performing a relative scanning between the plurality of nozzle arrays and the substrate to thereby selectively eject the filter material, whereby the filter element is formed.

10. The method according to claim 9, further comprising forming an overcoat film after having formed the filter element.

11. A method of manufacturing an organic EL in which a multiplicity of picture element pixels inclusive of EL layers are arranged on a substrate, by using the method of ejecting function liquid according to claim 3, wherein the function liquid is a luminescent material, the method comprising performing a relative scanning between the plurality of nozzle arrays and the substrate to thereby selectively eject the luminescent material, whereby the EL layers are formed.

12. The method according to claim 11, further comprising forming pixel electrode corresponding to the EL layers between the multiplicity of the EL layers and the substrate.

13. The method according to claim 12, further comprising forming counter electrode so as to cover the multiplicity of the EL layers.

14. A method of forming a spacer in which a multiplicity of particulate spacers are formed to constitute a minute cell gap between two substrates by using the method of ejecting function liquid according to claim 3, wherein the function liquid is a spacer material to constitute a cell gap, the method comprising performing a relative scanning between the plurality of nozzle arrays and the substrate to thereby selectively eject the spacer material, whereby the spacer is formed.

15. A method of forming a metallic wire on a substrate by using the method of ejecting function liquid according to claim 3, wherein the function liquid is a metallic wire, the method comprising performing a relative scanning between the plurality of nozzle arrays and the substrate to thereby selectively eject the metallic material, whereby the metallic wiring is formed.

16. A method of forming a lens in which a multiplicity of microlenses are formed on a substrate by using the method of ejecting function liquid according to claim 3, wherein the function liquid is a lens material, the method comprising performing a relative scanning between the plurality of nozzle arrays and the substrate to thereby selectively eject the lens material, whereby the microlenses are formed.

17. A method of forming a resist of an arbitrary shape by using the method of ejecting function liquid according to claim 3, wherein the function liquid is a resist material, the method comprising performing a relative scanning between the plurality of nozzle arrays and the substrate to thereby selectively eject the resist material, whereby the resist is formed.

18. A method of forming a light diffusion body on a substrate by using the method of ejecting function liquid according to claim 3, wherein the function liquid is a light diffusion material, the method comprising performing a relative scanning between the plurality of nozzle arrays and the substrate to thereby selectively eject the light diffusion material, whereby the light diffusion body is formed.

19. An electrooptic device manufactured by using the method of ejecting function liquid according to claim 3.

* * * * *